US011072482B2

(12) United States Patent
Aminoff et al.

(10) Patent No.: US 11,072,482 B2
(45) Date of Patent: Jul. 27, 2021

(54) THERMALLY INSULATED TRANSPORT BOX AND AN ARRANGEMENT IN A THERMALLY INSULATED TRANSPORT BOX

(71) Applicant: 2Cool Finland Oy, Iisalmi (FI)

(72) Inventors: Mikko Aminoff, Iisalmi (FI); Janne Naukkarinen, Iisalmi (FI); Erkki Lindeberg, Iisalmi (FI); Jukka Puustinen, Iisalmi (FI)

(73) Assignee: 2COOL FINLAND OY, Iisalmi (FI)

( * ) Notice: Subject to any disclaimer, the term of this patent is extended or adjusted under 35 U.S.C. 154(b) by 0 days.

(21) Appl. No.: 16/758,480

(22) PCT Filed: Nov. 12, 2018

(86) PCT No.: PCT/FI2018/050828
§ 371 (c)(1),
(2) Date: Apr. 23, 2020

(87) PCT Pub. No.: WO2019/092320
PCT Pub. Date: May 16, 2019

(65) Prior Publication Data

US 2020/0247602 A1 Aug. 6, 2020

(30) Foreign Application Priority Data

Nov. 13, 2017 (WO) ..... PCT/EP2017/079042
Apr. 18, 2018 (FI) ..... 20185366

(51) Int. Cl.
*B65D 81/38* (2006.01)
*A61J 1/16* (2006.01)
(Continued)

(52) U.S. Cl.
CPC ..... *B65D 81/3813* (2013.01); *A61J 1/165* (2013.01); *B65D 25/04* (2013.01); *B65D 81/18* (2013.01)

(58) Field of Classification Search
CPC .... B65D 25/06; B65D 90/0066; B65D 25/04; F25D 3/08; F25D 23/069;
(Continued)

(56) References Cited

U.S. PATENT DOCUMENTS 2,137,705 A * 11/1938 Tiefry ..... F25D 3/14 62/378
3,255,607 A * 6/1966 Bair ..... F25D 25/028 62/372
(Continued)

FOREIGN PATENT DOCUMENTS

CN 201314757 Y 9/2009
CN 103837030 A 6/2014
(Continued)

OTHER PUBLICATIONS

Finnish Patent and Registration Office, Search Report dated Oct. 26, 2018 issued in Finnish Patent Application No. 20185366.
(Continued)

*Primary Examiner* — Andrew T Kirsch
(74) *Attorney, Agent, or Firm* — Robert P. Michal, Esq.; Carter, DeLuca & Farrell LLP

(57) ABSTRACT

The invention relates to a thermally insulated transport box and an arrangement in a thermally insulated transport box, wherein the box comprises a cover and a box body. The box body side walls, end walls, an opening and a bottom wall. The inner surfaces of the side walls comprise half columns projecting from the side wall, wherein the inner surfaces of the end walls further comprise half columns projecting from the end wall, and the half columns run vertically along the
(Continued)

side walls and along the end walls. The box further comprises at least one partition wall comprising notches in its opposing edges, and as the partition wall is positioned to cover at least part of the opening the partition wall is supported by the half columns.

16 Claims, 21 Drawing Sheets

(51) Int. Cl.
*B65D 25/04* (2006.01)
*B65D 81/18* (2006.01)

(58) Field of Classification Search
CPC ..... F25D 2303/08221; F25D 2303/085; F25D 3/02; F25D 3/04; F25D 3/06; F25D 2303/0822; F25D 2303/083; F25D 2303/0831
See application file for complete search history.

(56) References Cited

U.S. PATENT DOCUMENTS 4,441,336 A 4/1984 Cannon
4,656,840 A * 4/1987 Loofbourrow ..... F25D 3/08 62/530
5,910,162 A * 6/1999 Harbour ..... A47F 3/0439 220/629
6,279,744 B1 * 8/2001 Yu ..... B25H 3/022 206/372
2006/0174648 A1 8/2006 Lantz
2011/1098256 8/2011 Rebstock

FOREIGN PATENT DOCUMENTS

DE 3031176 A1 4/1982
DE 102013003008 A1 8/2014
GB 2465376 A 5/2010
GB 2492195 A 12/2012
JP S56-118865 U 9/1981
JP 2015-193388 A 11/2015
KR 101783021 B1 9/2017
WO 1993024797 A1 9/1993
WO 2000049348 A1 8/2000
WO 2012143533 A1 10/2012

OTHER PUBLICATIONS

ISAEP, PCT International Search Report and Written Opinion dated Jul. 24, 2018 issued in PCT International Application No. PCT/EP2018/079042.
ISA/FI PCT International Search Report and Written Opinion dated Feb. 21, 2019 issued in PCT International Application No. PCT/FI2018/050828.
Supplementary European Search Report dated Nov. 18, 2020, issued in corresponding European Application No. 18877052, 2 pages.

* cited by examiner

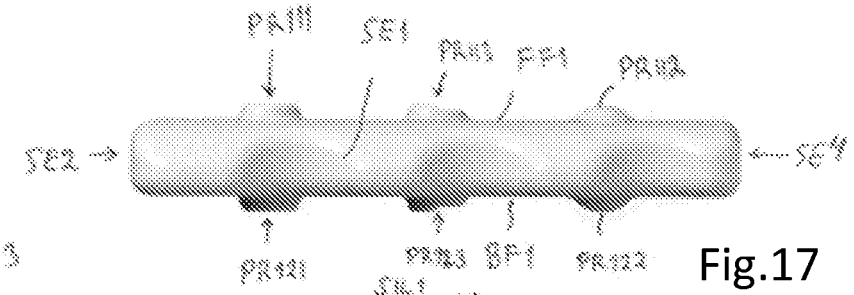
Fig.17
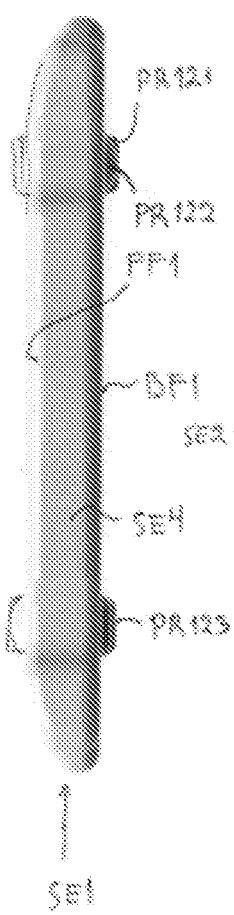
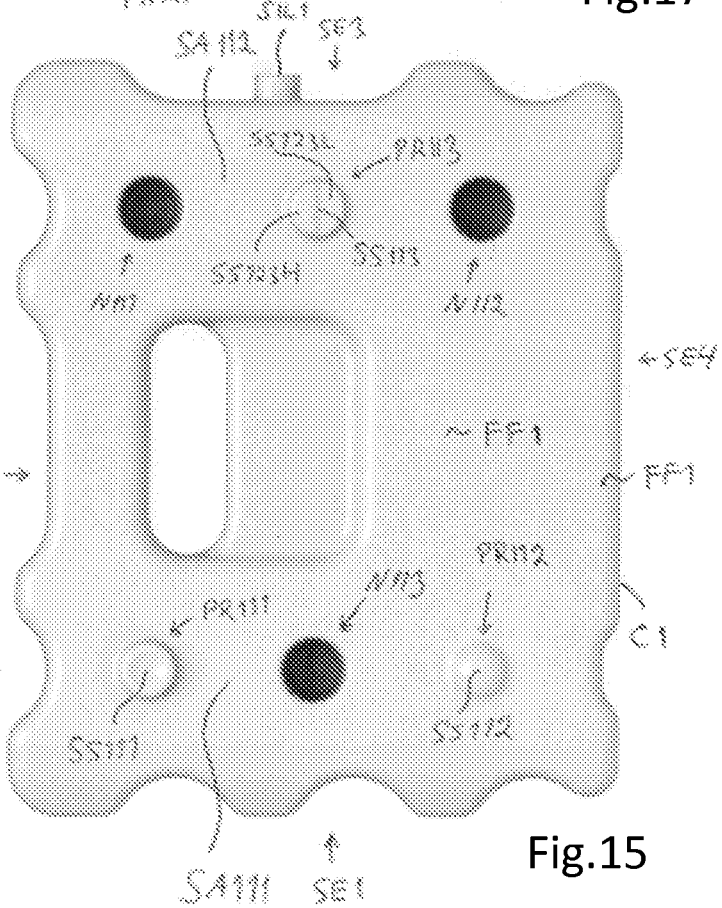
Fig.15
Fig.16

THERMALLY INSULATED TRANSPORT BOX AND AN ARRANGEMENT IN A THERMALLY INSULATED TRANSPORT BOX

CROSS-REFERENCE TO RELATED APPLICATIONS

This application is the United States National Stage entry under 35 U.S.C. 371 of PCT/FI2018/050828, filed Nov. 12, 2018, which in turn claims the priority of PCT/EP2017/079042, filed Nov. 13, 2017 and Finnish Patent Application No. 20185366, filed Apr. 18, 2018, the contents of each of which are hereby incorporated by reference in their entirety.

FIELD OF THE INVENTION

The present invention relates to a thermally insulated transport box and to an arrangement in a thermally insulated transport box, and particularly to a thermally insulated transport box, which is portable and can be used for transporting temperature sensitive goods.

BACKGROUND OF THE INVENTION

On certain occasions temperature sensitive goods such as drugs and foodstuffs need to be transported and temporary stored at containers where appropriate temperatures have to be maintained without electricity.

An example is a transportation of vaccines to remote areas. Immunization programs have been using insulated containers as vaccine carriers for decades. Typically, the last-mile transport of vaccines is made by humans walking or on motorbikes carrying the insulated container. The temperature range at which decay of most pharmaceutical compounds is the lowest is typically +2° C. . . . +8° C. However, because many vaccines are freeze sensitive it is also necessary to minimize the risk of freezing. Therefore, both the exceedance of the upper temperature limit and a shortfall of the temperature to below the lower limit in the vaccine carrier causes vaccine waste and reduces the number of humans vaccinated.

Another example is fairs and festivals where foodstuffs are sold outside. Temporary and mobile food vendors need to keep foods at chill temperatures below a legal maximum or at hot temperatures above a legal minimum. Chill holding in particular is very often critical to food safety.

There is a need for an insulated container, which is independent of the electric grid and can be reliably be used for transporting and temporary storing temperature sensitive goods and is able to keep the temperature of the goods inside the recommended temperature range.

BRIEF DESCRIPTION OF THE INVENTION

An object of the present invention to provide a thermally insulated transport box so as to overcome the above problems. The objects of the invention are achieved by a thermally insulated transport box which is characterized by what is stated in the independent claims. The preferred embodiments of the invention are disclosed in the dependent claims.

The invention is based on the idea of a thermally insulated transport box comprising a cover and a box body. The box body comprising side walls, end walls, an opening and a bottom wall. The inner surfaces of the side walls comprise half columns projecting from the side wall, the inner surfaces of the end walls comprise half columns projecting from the end wall, and the half columns run vertically along the side walls and along the end walls. The box comprises at least one partition wall comprising notches in its opposing edges, and as the partition wall is positioned to cover at least part of the opening the partition wall is supported by the half columns and at least part of the notches align with gaps between the half columns projecting from the side wall to form an air flow path, and the same partition wall is positionable between adjacent half columns to form a separating wall for creating two horizontally adjacent spaces, and a cold or heat accumulator is forming the partition wall, the cold or heat accumulator comprising a container for phase-change material, said container comprising a front face, a back face on the rear side of the container and side ends between the front face and the back face, and that the accumulator on front face and on the back face comprises protrusions and nests, said protrusions of the accumulator being arranged to be coupled with corresponding nests of an another accumulator, and said nests of the accumulator being arranged to be coupled with corresponding protrusions of said another accumulator so as to form a use-mode where the face of the container of the accumulator is arranged to be against the face of said another accumulator.

An advantage of the invention is that it reduces the unwanted heat transfer by conduction between the box body and the transported goods. Further, the invention enhances the convective air flow in the thermally insulated transport box. Additionally, the partition wall formed from a cold or heat accumulator can be located at a variety positions inside the box body providing a controlled temperature distribution inside the thermally insulated transport box.

In an embodiment, both on the front face and on the back face of the cold or heat accumulator forming a partition wall, the protrusions and nests may be arranged in groups in such way that first group, which is at the first surface area of the respective face of the container, comprises at least three members including at least two protrusions and at least one nest, and that the second group, which is at the second surface area of the respective face of the container, comprises at least three members including at least two nests and at least one protrusion, so that when the accumulator is arranged to be in a turned position compared to said another accumulator, the protrusions of the accumulator are arranged against the protrusions of said second accumulator, so as to form an air gap mode, where the face of the accumulator is arranged to be remote from the face of said another accumulator and thereby providing an air gap between the face of the accumulator and the face of said another accumulator.

By arranging the faces of the cold or heat accumulators forming the partition walls remote from each other and providing the air gap between the cold or heat accumulators the heat transfer between the cold or heat accumulator and its surroundings is increased.

As both protrusions and nests are arranged on both sides of the cold or heat accumulator forming a partition wall a plurality of the cold or heat accumulators can be stacked on a tight stack or on a stack with gaps between the cold or heat accumulators. A tight stack of cold or heat accumulators is able to keep the stored cold or stored heat over a longer time. A stack with gaps between the cold or heat accumulators allows an increased heat transfer with the surroundings. A stack with gaps between the cold or heat accumulators is advantageous when the cold or heat accumulator is charged as it reduces the required charging time, or when a rapid supplemental heating or cooling of the transported goods or temporary stored goods is needed within the thermally insulated transport box, for instance.

In another embodiment, on the face of the container the first group located on said first surface area and second group located on said second surface area may be next to different side ends of the container.

In yet another embodiment, on the face of the container, the first group locating on said first surface area and second group locating on said second surface area may be next to opposite-directed side ends of the container.

In an embodiment, on the face of the container the first group locating on said first surface area and second group locating on said second surface area may be parallel with each other.

In another embodiment, at positions where on the front face of the container there are protrusions, there may be nests on the back face of container. Correspondingly, at positions where on the front face of the container there are nests, there may be protrusions on the back face of container.

In an embodiment, one or more protrusion may comprise a support structure for positioning the protrusions of the cold or heat accumulator forming a partition wall against the protrusions of another cold or heat accumulator forming a partition wall, so as to create support against transversal movement.

In another embodiment, at each face at least three protrusions may comprise support structure thereof.

In yet another embodiment, the protrusions may have protrusion-specific support structure having different shape than the support structure in one or more other protrusion.

In yet another further embodiment, the one or more support structure may be a recess-wall of the hollow space at the end face of the protrusion.

In an embodiment, one or more support structure may be a step structure comprising a lower step and a higher step at the end face of the protrusion.

Further, in another embodiment, in the second group in the previous embodiment, which is at the second surface area of the respective face of the container, the protrusion, having a step structure as a support structure, may be located between the two nests.

Further, in yet another embodiment, in the first group of the previous embodiment, which is at the first surface area of the respective face of the container, the nest may be between the two protrusions.

Further, in yet another further embodiment, in the second group the protrusion having a step structure as a support structure may be located between the two nests and/or in the first group the nest may be between the two protrusions, and at the same longitudinal line on which there is a protrusion in the first group at the first surface area of the respective face of the container, there may be a nest at the second group at the second surface area of the respective face of the container. Correspondingly: at the same longitudinal line on which there is a nest in the first group at the first surface area of the respective face of the container, there may be a protrusion at the second group at the second surface area.

In an embodiment, the first group, which is at the first surface area of the respective face of the container, the nest may be between the two protrusions.

In an embodiment, at the same longitudinal line on which there is a protrusion in the first group at the first surface area of the respective face of the container, there may be a nest at the second group at the second surface area of the respective face of the container. Correspondingly: at the same longitudinal line on which there is a nest in the first group at the first surface area of the respective face of the container, there may be a protrusion at the second group at the second surface area.

In an embodiment, the protrusions of the cold or heat accumulator forming a partition wall may provide an air gap in relation to bottom wall or other wall of the thermally insulated transport box into which box the accumulator is inserted. Further, the protrusions of the cold or heat accumulator forming a partition wall prevent a direct contact of the front and back face of the cold or heat accumulator and the transported goods preventing a thermal shock. For instance, the cold or heat accumulator forming a partition wall may positioned on the bottom wall and the transported goods may positioned on the cold or heat accumulator.

In an embodiment, the inner surface of the side wall may comprise half columns along the length of the side wall. The partition wall or the separating partition can then be positioned to the gap between the half columns to any location in the lengthwise direction of the thermally insulated transport box. The length of the created spaces can then be adjusted based on the dimensions of the transported goods. Further, a plurality of partition walls can be positioned to the gaps between the half columns to create a plurality of spaces for the transported goods.

In an embodiment, the thermally insulated transport box may comprise at least one separating partition comprising notches in its opposing edges. As the separating partition is positioned to cover at least part of the opening the separating partition is supported by the half columns and at least part of the notches align with gaps between the half columns projecting from the side wall to form an air flow path. The same separating partition is positionable between adjacent half columns to form a separating wall for creating two horizontally adjacent spaces. The separating partition is a supporting surface for one or more cold or heat accumulators or for the transported goods, for instance.

In another embodiment, the thermally insulated transport box may comprise two substantially similar separating partitions.

In yet another embodiment, the bottom wall may comprise a plurality of substantially hemispherically shaped protrusions. The effect of the plurality of hemispherically shaped protrusions is that they reduce the physical contact between the bottom wall and the transported goods and they reduce the contact between the bottom wall and a cold or heat accumulator positioned on the bottom wall.

In yet another further embodiment, at least part of the plurality of substantially hemispherically shaped protrusions may be aligned in rows in a crosswise direction of the bottom wall, and a gap between two adjacent rows and a gap between two adjacent half columns projecting from the side wall are located substantially at the same location in the lengthwise direction of the box body. This allows the flow path for air from the upper part of the box body to continue along the bottom wall.

In an embodiment, the box body, the half columns and the plurality of substantially hemispherically shaped protrusions may comprise same material and form a unitary piece.

In another embodiment, at least part of the half columns projecting from the side walls may extend from the bottom wall to the upper part of the box body. As the air cools in the upper part of the box body it flows downwards along the formed flow path through the opening provided by the notch and a gap between two adjacent half columns and further down along the gap between two adjacent half columns. The half columns act as air flow guides.

In yet another embodiment, the half column projecting from the side wall may project from the side wall by less than half its diameter. The outward curved surface of the half column provides a small contact area between the box body and the transported goods inside the box body. Thus, the unwanted heat transfer by conduction between the box body and the transported temperature sensitive goods is reduced.

In yet another further embodiment, the same separating partition may be positionable to form a supporting surface for one or more cold or heat accumulators, and to form a supporting surface for the transported goods in a lower part of the box body.

Further, the partition wall, which is formed from a cold or heat accumulator, may be positionable to the upper part of the box body to cover the at least part of the opening, is positionable between adjacent half columns to form a separating wall and is positionable to the lower part of the box body on the bottom wall. Therefore, the number of different parts necessary to create and to control a wanted temperature distribution inside the thermally insulated transport box is reduced.

In an embodiment, as the partition wall formed from a cold or heat accumulator or the separating partition is positioned to a lower part of the box body, the notches may align with the half columns to surround the half columns. Therefore, during the carrying of the thermally insulated transport box, the partition wall formed from a cold or heat accumulator or the separating partition remain in place.

In another embodiment, the separating partition may comprise lip parts projecting from the edges, and as the separating partition is positioned to a lower part of the box body the lip parts touch the bottom wall and support the separating partition providing an air flow path between the bottom wall and the separating partition.

In yet another embodiment, the thermally insulated transport box may comprise a mounting tray for a temperature monitoring device. The mounting tray is attached to a separating partition, or to a partition wall formed from a cold or heat accumulator or to a cold accumulator or to a heat accumulator.

In yet another further embodiment, the thermally insulated transport box is portable and may comprise fixing points for a carrying member.

The invention is based on the idea of an arrangement in a thermally insulated transport box. The arrangement comprising a thermally insulated transport box, the thermally insulated transport box comprising a cover and a box body, the box body comprising side walls, end walls, an opening and a bottom wall. The inner surfaces of the side walls comprise half columns projecting from the side wall, the inner surfaces of the end walls comprise half columns projecting from the end wall, and the half columns run vertically along the side walls and along the end walls. The thermally insulated transport box comprises two partition walls, the partition wall comprising notches in its opposing edges. The partition wall is positionable to cover at least part of the opening where the partition wall is supported by the half columns and at least part of the notches align with gaps between the half columns projecting from the side wall to form an air flow path. A cold or heat accumulator is forming the partition wall, the cold or heat accumulator comprising a container for phase-change material, said container comprising a front face, a back face on the rear side of the container and side ends between the front face and the back face. The accumulator on front face and on the back face comprises protrusions and nests, said protrusions of the accumulator being arranged to be coupled with corresponding nests of an another accumulator, and said nests of the accumulator being arranged to be coupled with corresponding protrusions of said another accumulator so as to form a use-mode where the face of the container of the accumulator is arranged to be against the face of said another accumulator. The arrangement comprises a first and a second cold or heat accumulator forming the two partition walls, and the face of the container of the first accumulator is arranged to be against the face of the container of the second accumulator, and the first and the second accumulator are positioned between adjacent half columns for creating two horizontally adjacent spaces.

In an embodiment, the arrangement in a thermally insulated transport box may further comprise two cold or heat accumulators forming two partition walls. The accumulators are positioned side-by-side to cover the opening of the box, and the accumulators are supported by the half columns.

In another embodiment, in the arrangement the phase-change material in the container of the first accumulator may have a different melting/solidifying temperature than the phase-change material in the container of the second accumulator.

In yet another embodiment, the arrangement may further comprise two partition walls formed from a cold or heat accumulator positioned side-by-side on the bottom wall.

In yet another further embodiment, in the arrangement one of the partition walls may comprise a mounting tray for a temperature monitoring device and a real-time temperature monitoring device capable of sending data wireless to a receiver is attached to the mounting tray.

In an embodiment, the arrangement may comprise a moisture-absorbing member.

In another embodiment, the thermally insulated transport box may be used for transporting vaccines. Preferably, when the thermally insulated transport box 1 is used for transporting vaccines the phase change material has a melting temperature at a temperature range −2° C. . . . 0° C.

In yet another embodiment, the thermally insulated transport box may be used for temporary storing of perishable foodstuffs. Preferably, when the thermally insulated transport box 1 is used for temporary storing of perishable foodstuffs the phase change material has a melting temperature at a temperature range −2° C. . . . 2° C.

In yet another further embodiment, the arrangement may comprise one or more cold or heat accumulators comprising a phase change material. The separating partition may form a supporting surface for one or more cold or heat accumulators or provide a separating wall preventing freezing or overheating of the transported goods.

In an embodiment, the arrangement may comprise two separating partitions positioned on the bottom wall forming a lower surface and two separating partitions positioned to cover at least part of the opening forming an upper surface, and a space between the lower surface and the upper surface is split into two spaces in a crosswise direction of the box body by means of a first and a second cold or heat accumulator forming two partition walls, and the face of the container of the first accumulator is arranged to be against the face of the container of the second accumulator, and at least one of the separating partitions comprise a mounting tray for a temperature monitoring device and a real-time temperature monitoring device capable of sending data wireless to a receiver is attached to the mounting tray.

In another embodiment, the arrangement may further comprise a second thermally insulated transport box. In the second thermally insulated transport box one of the distance between end walls and the distance between side walls is smaller than in the thermally insulated transport box one of the distance between the end walls and the distance between the side walls. The arrangement comprises at least three partition walls. The partition wall is positionable to cover the opening of the second thermally insulated transport box where the partition wall is supported at least by two half columns of each side wall and each end wall. The partition wall is also positionable to cover the bottom wall of the second thermally insulated transport box.

BRIEF DESCRIPTION OF THE DRAWINGS

In the following the invention will be described in detail by means of preferred embodiments with reference to the attached drawings, in which

FIG. 15 shows the front face of a cold or heat accumulator forming a partition wall;

FIG. 16 shows a side view towards the long right side of the cold or heat accumulator shown in FIG. 15;

FIG. 17 shows a side view towards the short lower side of the cold or heat accumulator shown in FIG. 15;

DETAILED DESCRIPTION OF THE INVENTION

Figure 1:
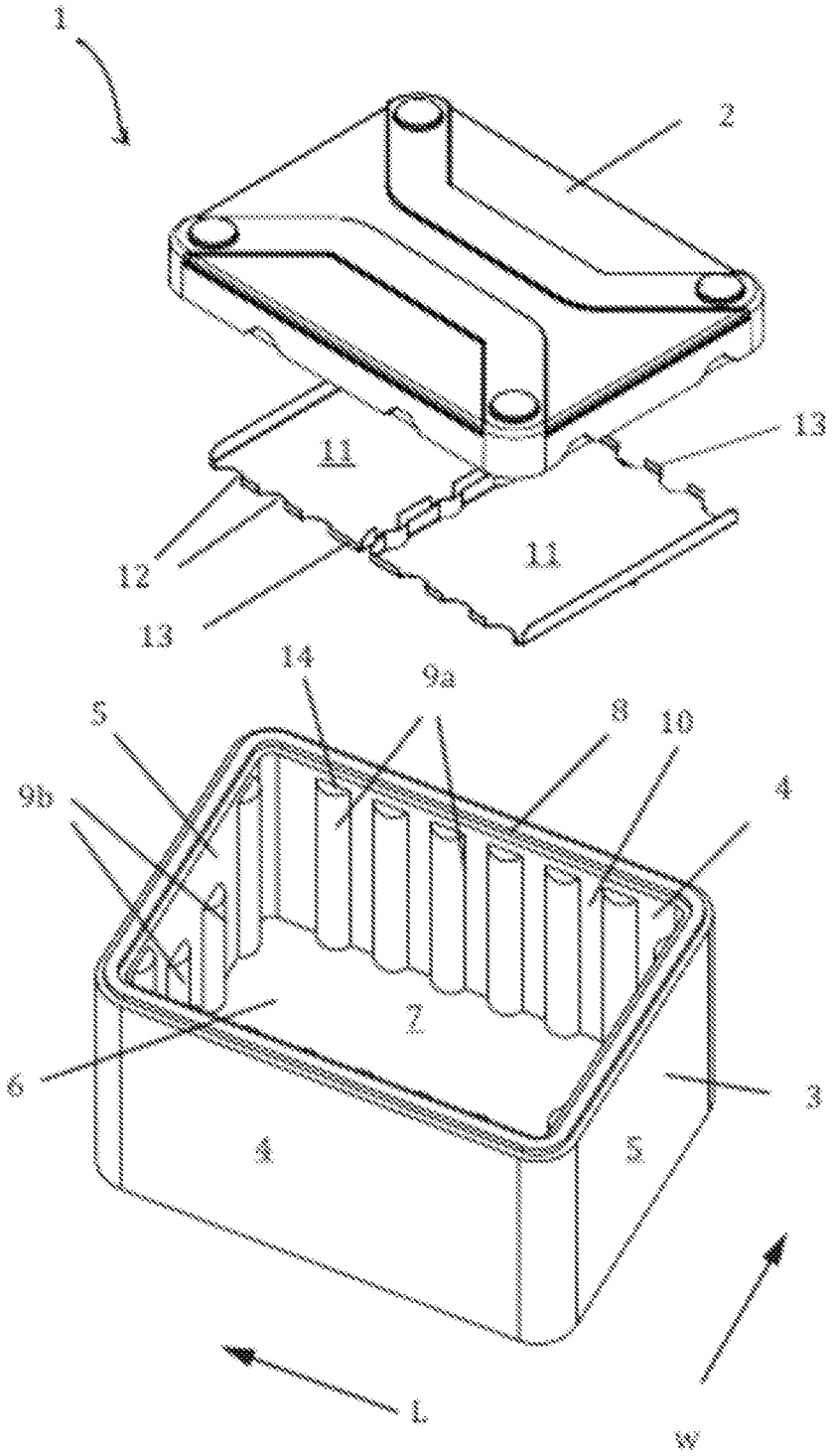
FIG. 1 shows a thermally insulated transport box.

FIG. 1 shows a thermally insulated transport box. The thermally insulated transport box 1 comprises a cover 2 and a box body 3. The box body 3 is closed with the cover 2. The box body 3 comprises side walls 4 in the lengthwise direction L, end walls 5 in the crosswise direction w, an opening 6 and a bottom wall 7. The upper edge of the box body 3 comprises a flange 8 surrounding the opening 6 and when the box body 3 is closed, the side walls of the cover 2 surround the flange 8.

The inner surfaces of the side walls of the box body 3 comprise half columns 9*a* projecting from the side wall 4. The inner surfaces of the end walls 5 comprise half columns 9*b* projecting from the end wall 5. The half columns 9*a-b* run vertically along the side walls 4 and along the end walls 5 and project inwards. Between two adjacent half columns 9*a-b* is a gap 10, which comprises a substantially flat wall part.

The box 1 comprises at least one separating partition 11 comprising notches 12 in its opposing edges 13. A separating partition 11 comprises a rectangular shape. As the separating partition 11 is positioned to cover at least part of the opening 6 the separating partition 11 is supported by the half columns 9*a-b*. The separating partition 11 rests on the ends of the half columns 14. At least part of the notches 12 align with gaps 10*a* between the half columns 9*a* projecting from the side wall 4 to form an air flow path.

The heat transfer by conduction occurs via physical contact between the box body 3 and the transported goods 15. The outward curved surface of the half column 9*a-b* provides a small contact area between the box body 3 and the transported goods 15 inside the box body 3. Thus, the unwanted heat transfer by conduction between the box body 3 and the transported temperature sensitive goods 15 is reduced.

For the sake of clarity, the ambient temperature can be lower than the required temperature inside the thermally insulated transport box 1 whereby the unwanted heat transfer is outwards. Thus, the box 1 can prevent the chilled transported goods 15 from freezing due to ambient cold temperature. The ambient temperature can be higher than the required temperature inside the thermally insulated transport box 1 whereby the unwanted heat transfer is inwards.

Cold accumulators 16 are preferably positioned on the separating partitions 11 supported by the half columns 9*a-b* to the upper part of the box body 3. As the air cools around the cold accumulators 16 it flows downwards along the formed flow path through the opening provided by the notch 12 and a gap 10 between two adjacent half columns and further down along the gap between two adjacent half columns 10. The half columns 9*a* act as air flow guides. The formed flow path enhances the convective air flow in the thermally insulated transport box 1. It is also advantageous that a cooled air flows between the transported goods 15 and the side wall 4 of the box body 3.

Figure 2:
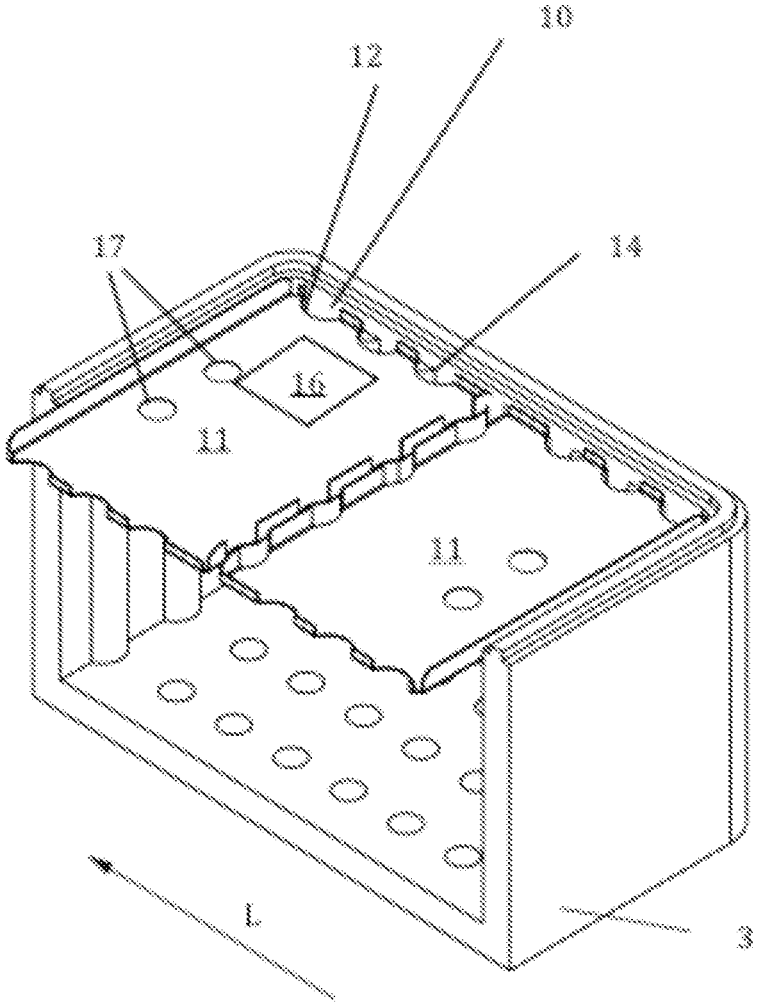
FIG. 2 shows a box body without a side wall.

FIG. 2 shows a box body 3 without a side wall proving a cross sectional view in the lengthwise direction of the box body 3. In the embodiment, the box body 3 comprises two substantially similar separating partitions 11. Parallel positioned separating partitions 11 cover the opening 6 of the box body 3. The separating partitions 11 comprise holes 17 for fingers for an easy handling of the separating partitions 11.

Figure 3:
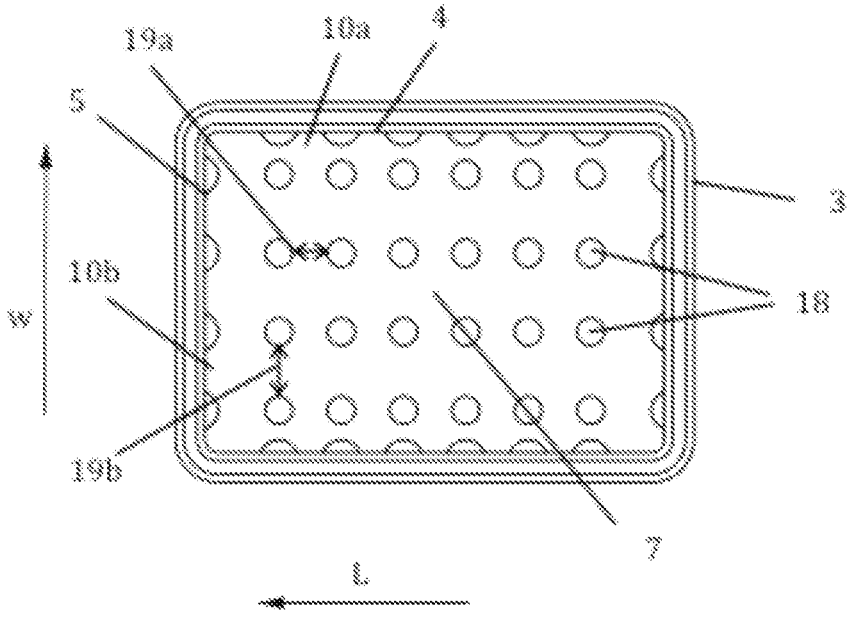
FIG. 3 shows a top view of a box body.

FIG. 3 shows a top view of a box body 3. In the embodiments shown in FIGS. 2-8 the bottom wall 7 of the box body 3 comprises a plurality of substantially hemispherically shaped protrusions 18. The effect of the plurality of hemispherically shaped protrusions 18 is that they reduce the physical contact between the bottom wall 7 and the transported goods 15 and they reduce the contact between the bottom wall 7 and a cold or heat accumulator 16 positioned on the bottom wall 7.

In the embodiment the plurality of hemispherically shaped protrusions 18 are aligned in rows in a crosswise direction w of the bottom wall 7. A gap between two adjacent rows 19 and a gap between two adjacent half columns 10*a* projecting from the side wall 4 are located substantially at the same location in the lengthwise direction L of the box body 3. As the gaps 10*a*,19*a* coincide at the junction of a side wall 4 and a bottom wall 7 the flow path for air from the upper part of the box body 3 continues along the bottom wall 7. Additionally, a crosswise w inserted separating partition 11 or a partition wall 22 can then reach the bottom wall 7.

In FIG. 3 is shown also another embodiment where the plurality of hemispherically shaped protrusions 18 are aligned in rows in a lengthwise direction L of the bottom wall 7. A gap between two adjacent rows 19*b* and a gap between two adjacent half columns projecting from the end wall 10*b* are located substantially at the same location in the crosswise direction of the box body 3. As the gaps 10*b*, 19*b* coincide at the junction of an end wall 5 and a bottom wall 7 the flow path for air from the upper part of the box body 3 continues along the bottom wall 7 horizontally.

In the Figures the box body 3, the half columns 9*a-b* and the plurality of substantially hemispherically shaped protrusions 18 comprise same material and form a unitary piece. The half columns 9*a-b* and the plurality of substantially hemispherically shaped protrusions 18 can also comprise separate elements. The half columns 9*a-b* can be formed with a plate comprising a plurality of half columns and the plate is attached to the box body 3. The half columns 9*a-b* can also comprise separate single pieces attached to the box body 3 individually. The hemispherically shaped protrusions 18 can be formed with a plate comprising a plurality of hemispherically shaped protrusions 18 and the plate is attached to the box body 3. The hemispherically shaped protrusions 18 can also comprise separate single pieces attached to the box body 3 individually.

In an embodiment, the half column 9*a* projecting from the side wall 4 projects from the side wall 4 by less than half its diameter.

In an embodiment at least part of the half columns 9*a* projecting from the side walls 4 extend from the bottom wall 7 to the upper part of the box body 3.

FIGS. 4-7 show different embodiments of positioning one or more separating partitions 11. In the embodiments the same separating partition 11 is positionable to form a supporting surface for one or more cold or heat accumulators 16, to form a supporting surface for the transported goods 15 in a lower part of the box body 3 and to form a separating wall for creating two horizontally adjacent spaces 20*a-b*. It is an advantage of the thermally insulated transport box 1 that different types of transporting arrangements can be formed to cover a temperature range of −50° C. . . . +85° C. for the transportable goods 15. Examples of materials suitable for manufacturing material of a separating partition 11 are aluminium and plastics.

By the term of substantially similar separating partitions is meant separating partitions having similar outer dimensions, similar notching necessary to form the flow paths and necessary to surround the outer surface of the half column when the separating partition is installed above the bottom wall to the lower part of the box body 3.

Figure 4:
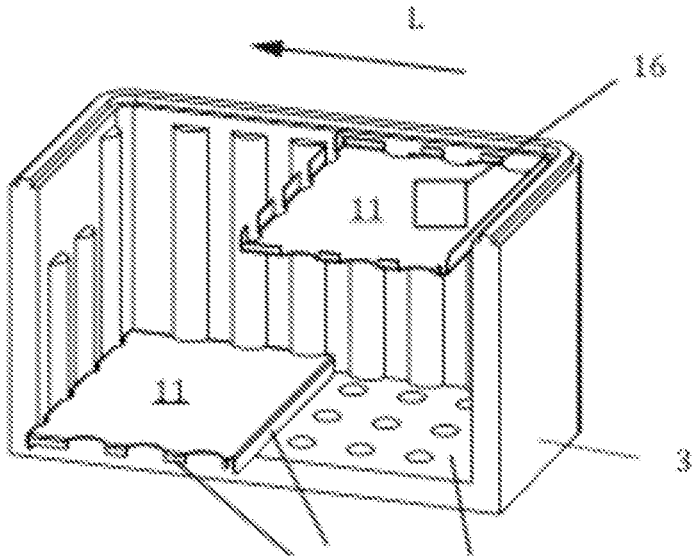
FIG. 4 shows a box body without a side wall.
Figure 6:
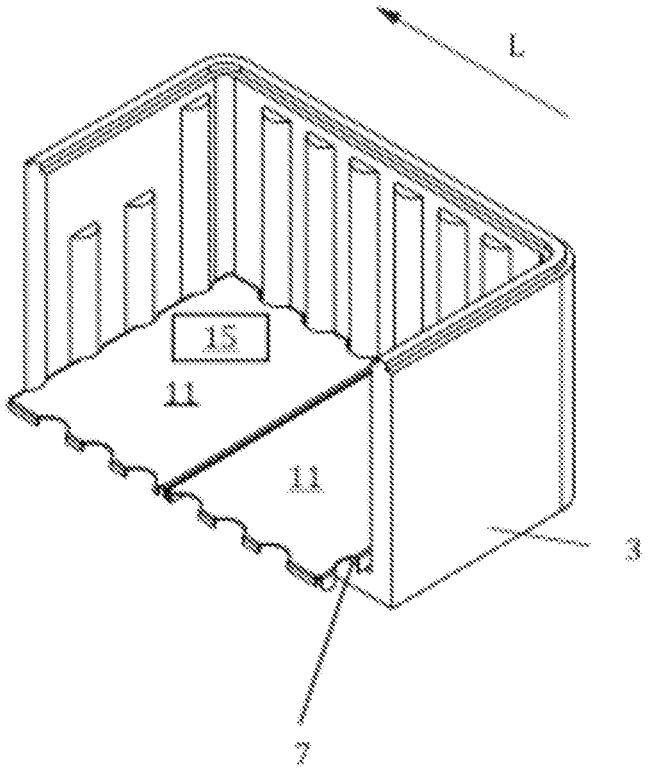
FIG. 6 shows a box body without a side wall.
Figure 7:
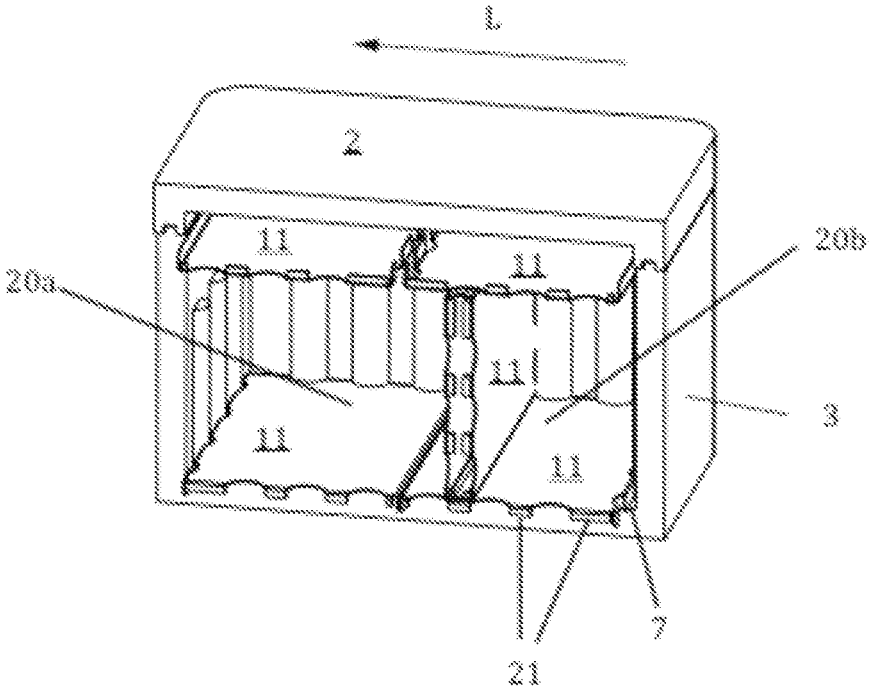
FIG. 7 shows a cross sectional view of a thermally insulated transport box.

In the embodiments, the separating partition 11 comprises lip parts 21 projecting from the edges 13. As the separating partition 11 is positioned to a lower part of the box body 3 the lip parts 21 touch the bottom wall 7 and support the separating partition 11 providing a flow path between the bottom wall 7 and the separating partition 11 as shown in FIGS. 4, 6 and 7. To allow an unobstructed air flow path the notch 12 of the separating partition 11 does not comprise a lip part 21.

In the embodiments the separating partition comprises 11 notches 12 in three edges 13.

The notches 12 of the separating partition 11 shown in Figures comprise a curved shape to surround the outer surface of the half column 9*a-b* when the separating partition is installed above the bottom wall 7 to the lower part of the box body 3.

FIG. 4 shows a box body 3 without a side wall comprising two separating partitions 11. The separating partitions 11 are assembled to the upper part of the box body 3 and to the lower part of the box body 3. The separating partition 11 assembled to the upper part of the box body 3 forms a supporting surface for one or more cold or heat accumulators 16. The separating partition 11 assembled to the lower part of the box body 3 is supported to the bottom wall 7 and forms a supporting surface for the transported goods 15 (not shown). The separating partition 11 prevents also the direct heat transfer by conduction from the bottom wall 7 to the transported goods 15. Further, if the lower part of the box body 3 is provided with one or more cold or heat accumulators 16 positioned on the bottom wall 7, the separating partition 11 supported to the bottom wall 7 provides a separating wall preventing freezing or overheating of the transported goods 15.

Figure 5:
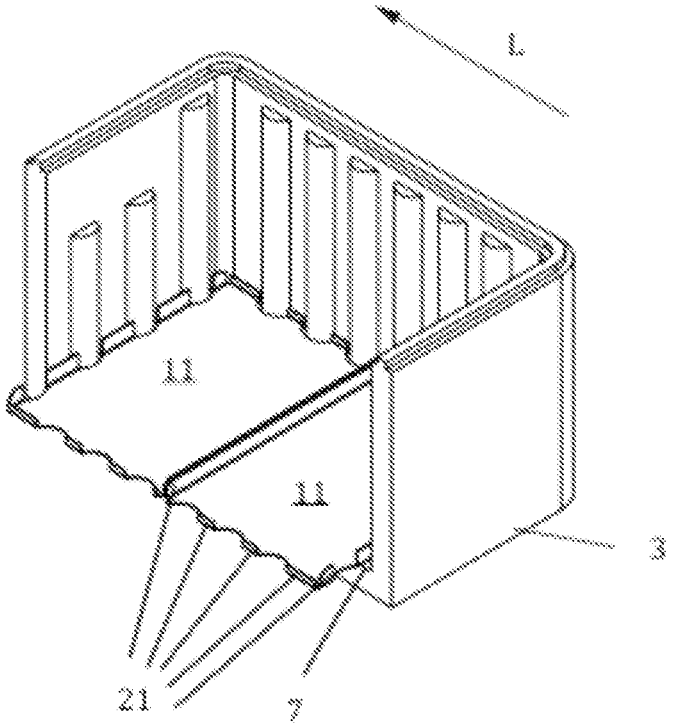
FIG. 5 shows a box body without a side wall.

FIG. 5 shows a box body 3 without a side wall proving a cross sectional view in the lengthwise direction L of the box body 3. The box body 3 comprises two separating partitions 11 assembled on the lower part of the box body 3. The separating partition 11 rests on the bottom wall 7 on the protrusions 18 the lips 21 facing upwards. The separating partitions 11 form a supporting surface for the transported goods 15 (not shown).

FIG. 6 shows a box body 3 without a side wall proving a cross sectional view in the lengthwise direction L of the box body 3. The box body 3 comprises two separating partitions 11 assembled on the lower part of the box body 3. The lip parts 21 of the separating partition 11 touch the bottom wall 7 and support the separating partition 11 providing a flow path between the bottom wall 7 and the separating partition 11. The separating partitions form a supporting surface for the transported goods 15. Further, if the one or more cold or heat accumulators 16 are positioned on the bottom wall 7, the separating partition 11 supported to the bottom wall 7 provides a separating wall preventing freezing or overheating of the transported goods 15.

FIG. 7 shows a thermally insulated transport box 1 where the box body 3 and the cover 2 are shown without side walls proving a cross sectional view in the lengthwise direction L of the thermally insulated transport box 1.

The thermally insulated transport box 1 comprises a plurality of substantially similar separating partitions 11. Two of the separating partitions 11 are assembled to the upper part of the box body 3 to form a supporting surface for one or more cold or heat accumulators 16 (not shown).

Two of the separating partitions 11 are assembled on the lower part of the box body 3 and cover the bottom wall 7. The lip parts 21 of the separating partition 11 touch the bottom wall 7 and support the separating partition 11 providing a flow path between the bottom wall 7 and the separating partition 11. The separating partitions 11 form a supporting surface for the transported goods 15 (not shown).

Further, if the one or more cold or heat accumulators 16 are positioned on the bottom wall 7, the separating partition 11 supported to the bottom wall 7 pros vides a separating wall preventing freezing or overheating of the transported goods 15.

Two of the separating partitions 11 are assembled opposite each other to form an enclosure for one or more cold or heat accumulators 16. This enclosure comprising two separating partitions 11 forms a separating wall creating two in the lengthwise L of the box body 3 adjacent spaces 20*a-b*.

The separating partition 11 is slidable in vertical direction between two adjacent half columns 9*a* projecting from a side wall 4. When assembled the separating partition 11 extends between the two opposing side walls 4 forming a separating wall whereby creating two adjacent spaces 20*a-b* to the box body 3. The half columns 9*a* projecting from the first side wall 4 support the first end of the separating partition and the half columns 9*a* projecting from the second side wall 4 support the second end of the separating partition 11. The half columns 9*a* keep the separating partition 11 in an upright position.

An accumulator 16 comprising phase change material is advantageous in providing passive cooling or heating in the thermally insulated transport box 1. A phase change material with a high heat of fusion that through melting and solidifying at a certain temperature is capable of storing and releasing large amounts of energy. A cold accumulator and a heat accumulator suitable for the thermally insulated transport box 1 comprises a phase change material, which has its melting/solidifying temperature at a temperature range −50° C. . . . +85° C.

During the transportation of the transported goods 15 or during a temporary storing of transported goods 15 the thermally insulated transport box 1 can comprise cold accumulators 16 comprising phase change material, which have different melting/solidifying temperatures. The thermally insulated transport box 1 can also comprise heat accumulators 16 comprising phase change material, which have different melting/solidifying temperatures. By means of the cold accumulators 16 providing cold at different temperatures the temperature distribution inside the thermally insulated transport box 1 can be created and controlled. By means of the heat accumulators 16 providing heat at different temperatures the temperature distribution inside the thermally insulated transport box 1 can be created and controlled.

For instance, in FIG. 7 shown arrangement comprises two adjacent spaces 20*a-b*. The temperature of the first space 20*a* can be 5° C. . . . +35° C. higher than the temperature of the second space 20*b*. This can be achieved by providing cold/heat accumulators 16 having higher melting/solidifying temperatures above and below the first space 20*a* and providing cold/heat accumulators having lower melting/solidifying temperatures above and below the second space 20*b*.

The cold or heat content of a thermally insulated transport box 1 depends on the amount of filling and the thermal capacity of the filling inside the box. The shape of the interior face of the thermally insulated transport box 1 provides a substantially rectangular shaped packing space. The substantially rectangular shaped packing space allows an effective use of a packing space thus providing a high filling ratio and a large carrying capacity. It allows also an easier packing operation that saves time.

The arranged cold air circulation within the thermally insulated transport box together with the reduced heat transfer by conduction between the box body 3 and the transported goods 15 results in a reduced thickness of the box body 3. This increases capacity inside the box. Therefore, the thermally insulated transport box 1 requires less space to transport a given volume of goods making more efficient use of transport volume. The reduced thickness of the box body 3 also reduces the weight of the thermally insulated transport box, which is important when the box 1 is carried by a human.

Many vaccines are freeze sensitive, including cholera and inactivated polio vaccines, and the risk of freezing has to be minimized. The separating partitions 11 within the thermally insulated transport box 1 prevent a direct contact of a cold accumulator 16 and the transported goods 15 thus preventing a thermal shock. The use of an accumulator 16 comprising phase change material having an operating temperature at a range +2° C. . . . +8° C. also prevents freezing. Preferably, when the thermally insulated transport box 1 is used for transporting vaccines the phase change material has a melting temperature at a temperature range −2° C. . . . 0° C.

The thermally insulated transport box may comprise one or more partition walls 22. The partition wall 22 is a separate part and its end is slidable between adjacent half columns 9*a* projecting from a side wall 4. When assembled the partition wall 22 extends between the two opposing side walls 4 creating two adjacent spaces. The half columns 9*a* projecting from the first side wall 4 support the first end of the partition wall 22 and the half columns 9*a* projecting from the second side wall 4 support the second end of the partition wall 22. The half columns 9*a* keep the partition wall in an upright position. The partition wall 22 is made of plate material, e.g. expanded polypropylene (EPP), for instance.

The thermally insulated transport box 1 may comprise one or more partition walls 22,22*b* which is formed from a cold accumulator or a heat accumulator A1,A2. The partition walls 22,22*b* being a cold or heat accumulators may be used in the thermally insulated transport box 1 instead of a separating partitions 11, or together with one or more separation partitions 11. Alternative types of partition walls 22,22*b* are shown in FIGS. 9 and 15-24.

Figure 9:
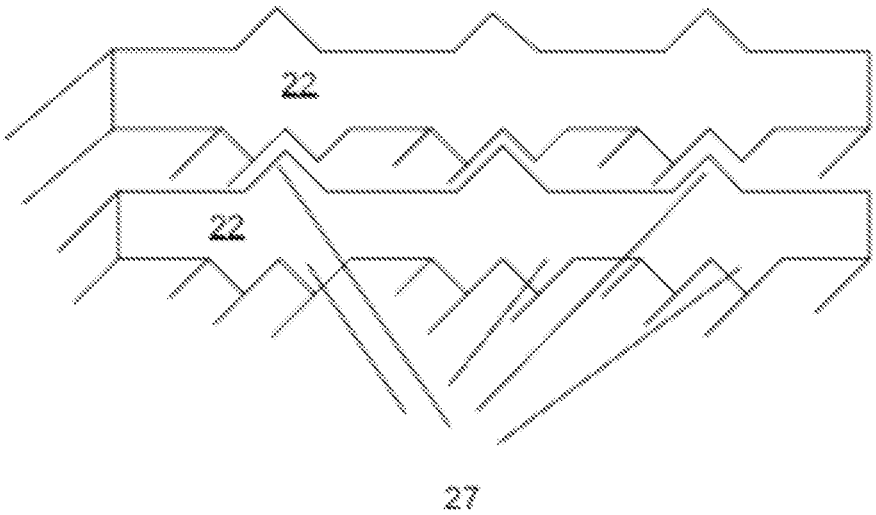
FIG. 9 shows a partition wall comprising a cold or heat accumulator.
Figure 10:
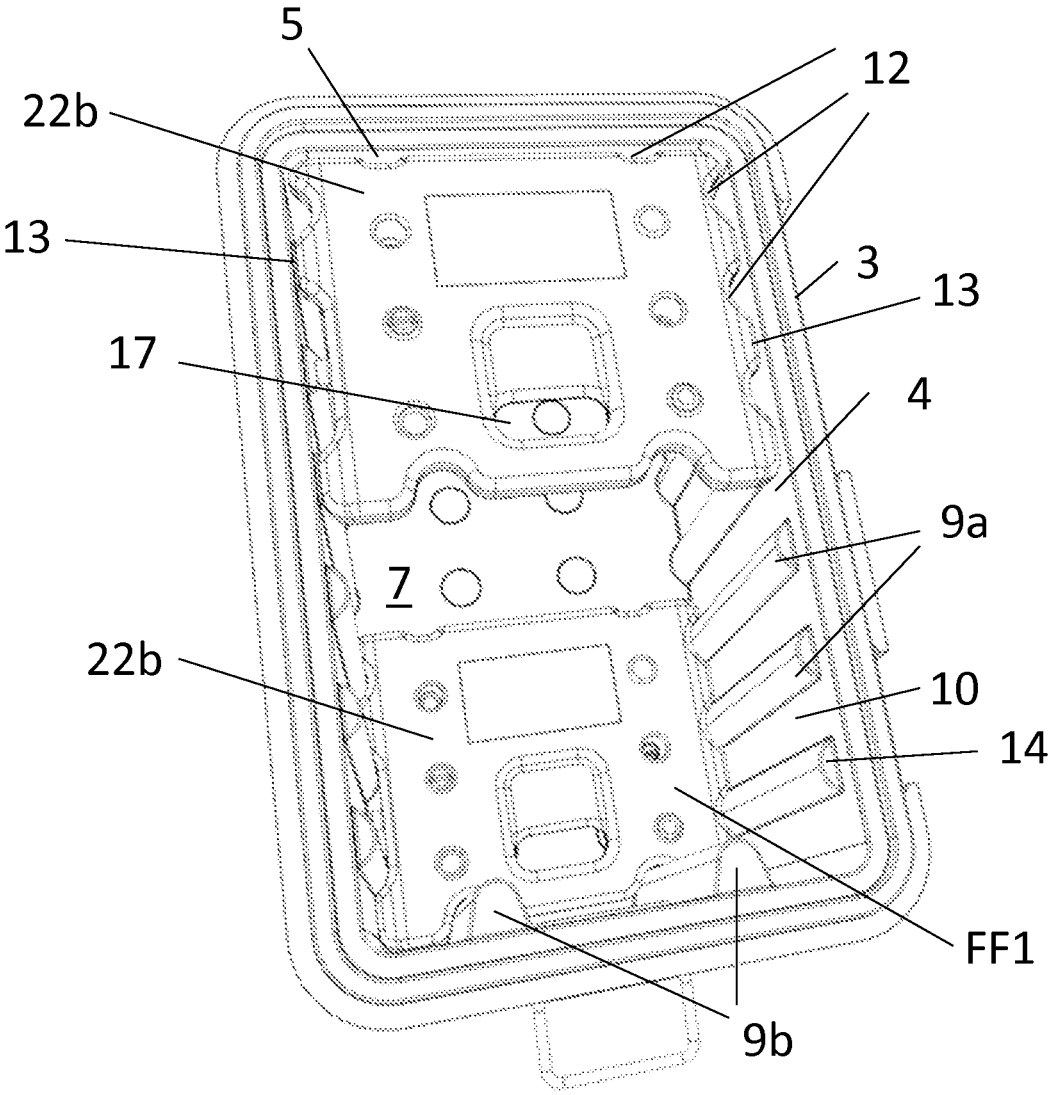
FIG. 10 shows a thermally insulated transport box without a cover.

Referring to FIG. 9, the thermally insulated transport box 1 may comprise a partition wall 22 comprising a cold accumulator or a heat accumulator 16, and the cold accumulator or the heat accumulator 16 comprises projecting parts 27 at least on one side surface. An example of the partition wall 22 comprising a cold accumulator or a heat accumulator 16 is shown in FIG. 9. The cold or heat accumulator 16 forming a partition wall 22 preferably comprises projecting parts 27 on its outer surface. The projecting parts 27 can be arranged on a one side surface only, or on the both side surfaces. If the projecting parts 27 are arranged to both of the side surfaces then preferably the projecting parts 27 comprise different sizes and positions depending on the side surface. Thus, a first side surface comprises projecting parts 27, which are higher than the projecting parts 27 comprised in a second side surface. Preferably, the projecting parts 27 comprised in a second side surface have a height of 40-60% of the height of the projecting parts 27 of the first side surface. The projecting parts 27 of the first and second side surfaces have preferably different locations such as when two accumulators used for forming a partition wall 22 are stacked with a first side of surface of the first accumulator facing a second side surface of the second accumulator the projecting parts 27 of the accumulators touch each other at least partially such that an air flow path is formed between the partition walls 22. The air flow path increases the heat transfer between the partition walls 22 and the ambient air when stacked. The cold accumulator or the heat accumulator comprises a phase change material inside, e.g. a liquid polymere.

The thermally insulated transport box 1 may also comprises a continuous temperature monitor to record the temperature a thermally insulated transport box. The temperature monitoring is preferably made by a real-time monitoring device 23 capable of sending data wireless to a receiver. The receiver may be a network server or a cloud, for instance. The thermally insulated transport box 1 may also comprise a releasable display on its outer surface for convenience. The temperature monitoring device 23 is preferably attached to a separating partition 11 comprising a mounting tray 24 for the temperature monitoring device 23, or to a partition wall 22 comprising a mounting tray 24 for the temperature monitoring device 23. The temperature monitoring device 23 can also be in a close vicinity of the transported goods 15 during the transportation. The effect of attaching the temperature monitoring device 23 to a separating partition 11 or to a partition wall 22 supporting a cold accumulator or a heat accumulator 16 is that it provides information on the change of the temperature inside the thermally insulated transport box 1 before the change reaches the transported goods 15.

The thermally insulated transport box 1 may also comprise a separate moisture-absorbing member. The moisture-absorbing member can comprise a moisture absorbing polymer mat, for instance. The moisture-absorbing member is preferably positioned on the bottom wall 7, or it is positioned to surround the transported goods 15.

Figure 8:
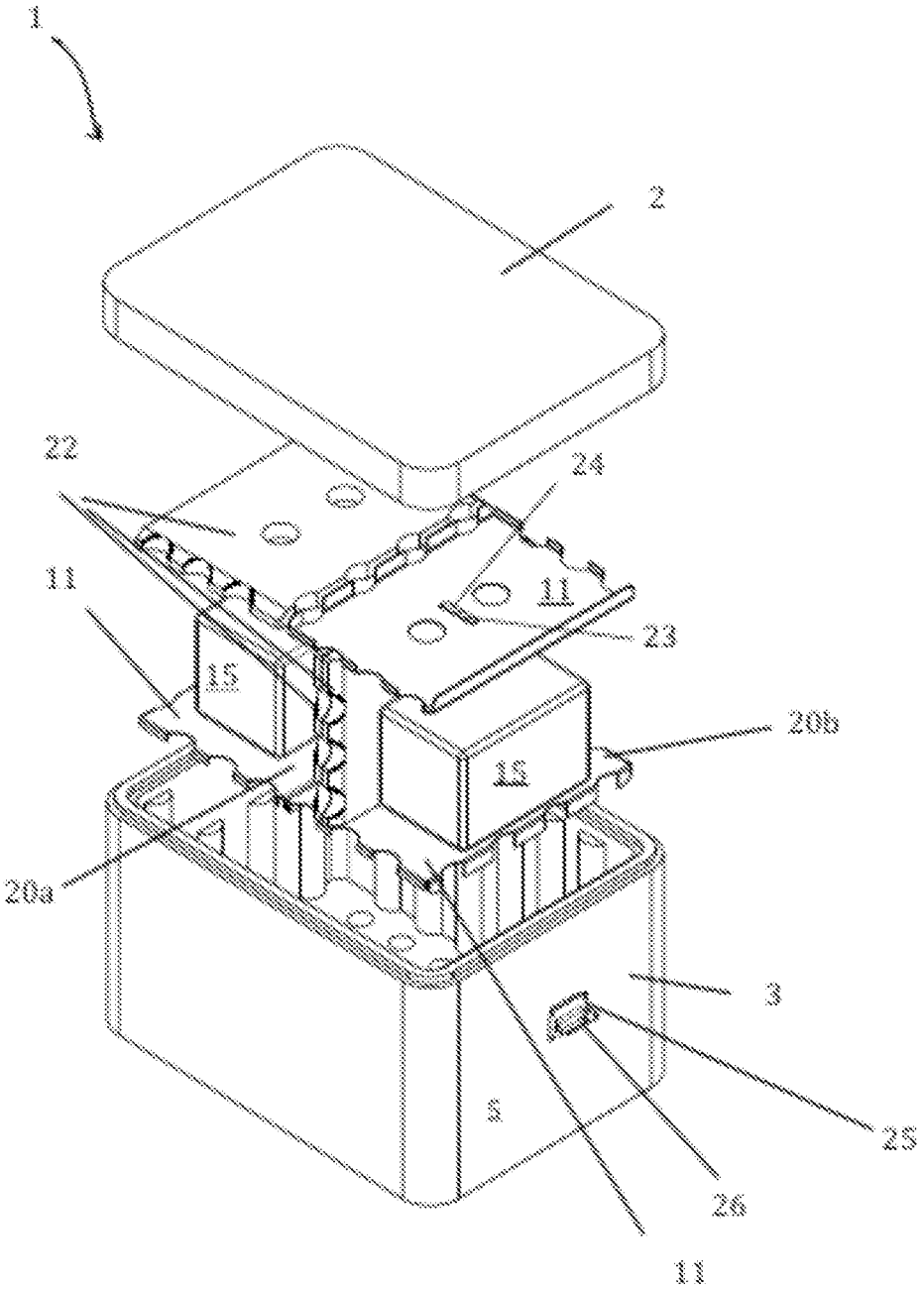
FIG. 8 shows an arrangement in a thermally insulated transport box

FIG. 8 shows an arrangement in a thermally insulated transport box 1. The thermally insulated transport box 1 comprises a cover 2 and a box body 3. The thermally insulated transport box 1 is portable and comprises fixing points 25 for a carrying member 26. The carrying member is handles provided at both end walls 5 of the box body 3.

The lower part of the box body 3 comprises two separating partitions 11 positioned parallel above the bottom wall 7 and supported by the lip parts 21 touching the bottom wall 7. The separating partitions 11 support the transported goods 15 positioned in the box body 3. The separating partitions 11 form a lower surface in the box body 3.

The upper part of the box body 3 comprises a separating partition 11 and a partition wall 22 formed from a cold accumulator or a heat accumulator. The separating partition 11 and the partition wall 22 are supported by the half columns of the side walls and end walls. The separating partition 11 and a partition wall 22 form an upper surface in the box body 3. The upper surface may comprise also two separating partitions 11.

The space between the lower surface and the upper surface inside the box body 3 is split into two spaces 20*a-b* by means of a partition wall 22. The partition wall 22 comprises two partition walls 22 laid together. The partition wall 22 is formed from a cold accumulator or a heat accumulator. The spaces 20*a-b* are on the same horizontal level. Each space 20*a-b* comprises transported goods 15.

The separating partition 11 comprises a mounting tray 24 for a temperature monitoring device 23.

The partition walls 22 formed from cold or heat accumulators comprise phase change material. The together laid cold or heat accumulators forming the partition wall 22 in the crosswise direction w of the box body 3 have different melting/solidifying temperatures.

The arrangement comprises a cold or heat accumulator laid on the separating partition 11 on the upper part of the box body 3 (not shown).

FIGS. 10-13 show an embodiment where the thermally insulated transport box 1 comprises one or more partition walls 22*b* where a cold or heat accumulator A1,A2 is forming the partition wall 22*b*. As the partition wall 22*b*, i.e. the cold or heat accumulator A1,A2, is positioned to cover at least part of the opening 6 of the thermally insulated transport box 1 the partition wall 22*b* is supported by the half columns 9*a-b*. The partition wall 22*b* rests on the ends of the half columns 14. At least part of the notches 12 in the opposing edges 13 of the partition wall 22*b* align with gaps 10*a* between the half columns 9*a* projecting from the side wall 4 to form an air flow path.

Figure 11:
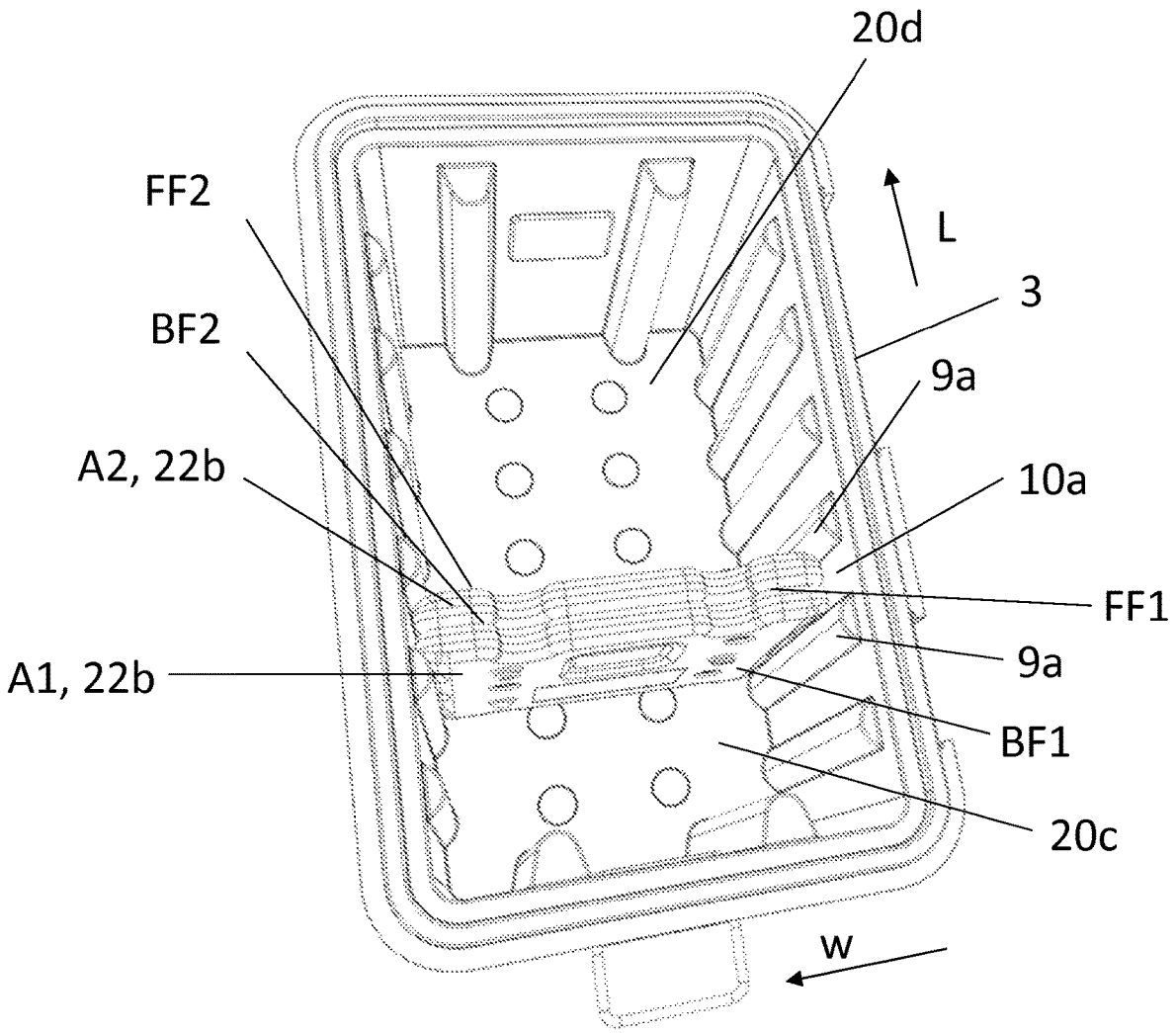
FIG. 11 shows a thermally insulated transport box without a cover.

The same partition wall 22*b* is positionable between a gap 10*a* between adjacent half columns 9*a* to form a separating wall for creating two horizontally adjacent spaces 20*c-d* in the lengthwise direction L of the box body 3 as shown in FIG. 11.

As shown in Figures, the inner surface of the side wall 4 comprises half columns along the length of the side wall 4. The partition wall 22,22*b* and/or the separating partition 11 can then be positioned to the gap 10 between the half columns 9*a* to any location in the lengthwise direction L of the thermally insulated transport box 1. The length of the created spaces can then be adjusted based on the dimensions of the transported goods 15.

The cold or heat accumulator A1,A2 forming a partition wall 22*b* comprises a container C1 for phase-change material, said container comprising a front face FF1, a back face BF1 on the rear side of the container C1 and side ends SE1-SE4 between the front face FF1 and the back face BF1. The cold or heat accumulator A1 on front face FF1 and on the back face BF1 comprises protrusions PR111-PR113, PR121-PR123 and nests N111-N113, N121-N123, said protrusions PR111-PR113 of the accumulator A1 being arranged to be coupled with corresponding nests N221-N223 of an another accumulator A2, and said nests N111-N113 of the accumulator A1 being arranged to be coupled with corresponding protrusions of said another accumulator A2 so as to form a use-mode where the face FF1 of the container C1 of the accumulator A1 is arranged to be against the face BF2 of said another accumulator A2.

In FIG. 11, two cold or heat accumulators A1,A2 are provided in one gap 10*a* between adjacent half columns 9*a*, and the two cold or heat accumulators A1,A2 are arranged in a use-mode where the front face FF1 of the accumulator A1 is arranged to be against the back face BF2 of another accumulator A2. The created tight stack of cold or heat accumulators A1,A2 is able to keep the stored cold or stored heat over a longer time.

Figure 12:
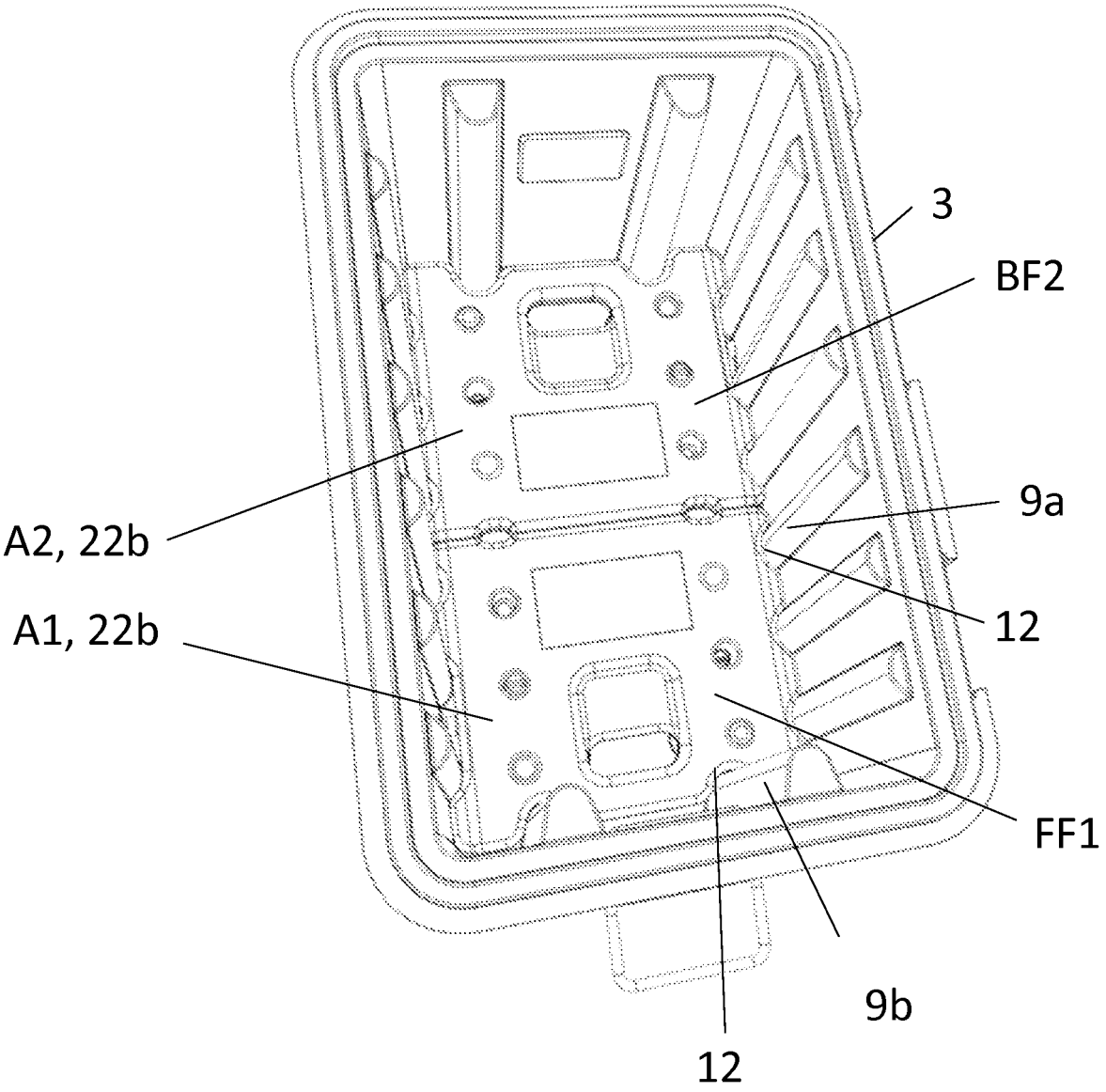
FIG. 12 shows a thermally insulated transport box without a cover.

FIG. 12 shows two partition walls 22*b* positioned side-by-side on the bottom wall 7. As the partition wall 22*b* is positioned to a lower part of the box body 3 the notches 12 align with the half columns 9*a,b* to surround the half columns 9*a,b*. The partition wall 22*b*, i.e. the cold or heat accumulator, comprises notches 12 in all edges 13 As shown in FIGS. 10-24 the number and the size of the notches 12 varies depending on the edge 13. For instance, the notches 12 which are to be positioned to form an air flow path from the upper part of the box 1 along the end wall 5 can be smaller than the notches 12 which are positioned to surround the half columns 9*b* of the end walls 5 at the lower part of the box 1.

Figure 13:
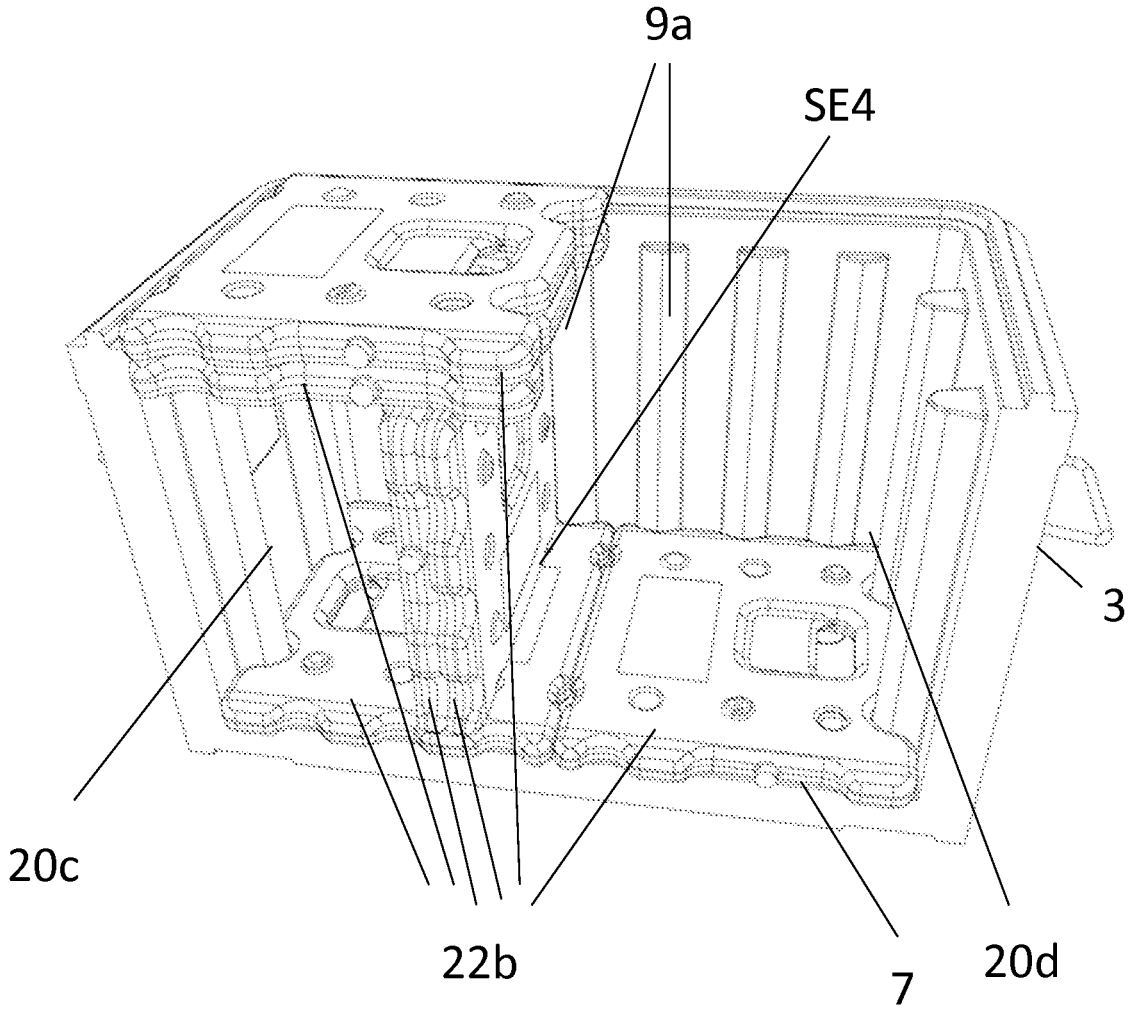
FIG. 13 shows an arrangement in a thermally insulated transport box without a cover and a side wall.

The arrangement of FIG. 13 comprises a plurality of cold or heat accumulators forming the partition walls 22*b*. Two partition walls 22*b* are positioned side-by-side on the bottom wall 7 to cover the bottom wall 7. Two partition walls 22*b* are provided in one gap 10*a* between adjacent half columns 9*a*, and the cold or heat accumulators forming the partition walls 22*b* are arranged in a use-mode. The partition walls 22*b* arranged upright to the gap 10*a* are supported by the partition walls 22*b* positioned side-by-side on the bottom wall 7, i.e. a side end SE4 of the cold or heat accumulator arranged upright is against the face of the cold or heat accumulator positioned on the bottom wall 7. Then the opening 6 is covered with a set of two partition walls 22*b* arranged one above the other and a further partition wall 22*b*. The set of two partition walls 22*b* comprises two cold or heat accumulators arranged in a use-mode. The further partition wall 22*b* is positioned side-by-side with the set of two partition walls 22*b* to cover the opening 6. The further partition wall 22*b* can comprise one cold or heat accumulator or a set of partition walls 22*b* comprising two cold or heat accumulators arranged in a use-mode. The further partition wall 22*b* is omitted from the FIG. 13 for a sake of clarity.

The shown arrangement in FIG. 13 provides a transport arrangement for transported goods where the transported goods require different temperature ranges during the transport. In case the cold or heat accumulators are cold accumulators, in the arrangement the cold accumulators positioned on the bottom wall prevent the heat transferred through the bottom to reach the transported goods. The cold accumulators positioned upright provide separate spaces within the box. The temperature range in the spaces can be adjusted by choosing cold accumulators comprising different melting temperatures to the lower and upper part of the box as well as to the upright partition wall. The cold accumulators positioned to cover the opening provide a downwards flowing cold air flow along the formed air flow path.

Figure 14:
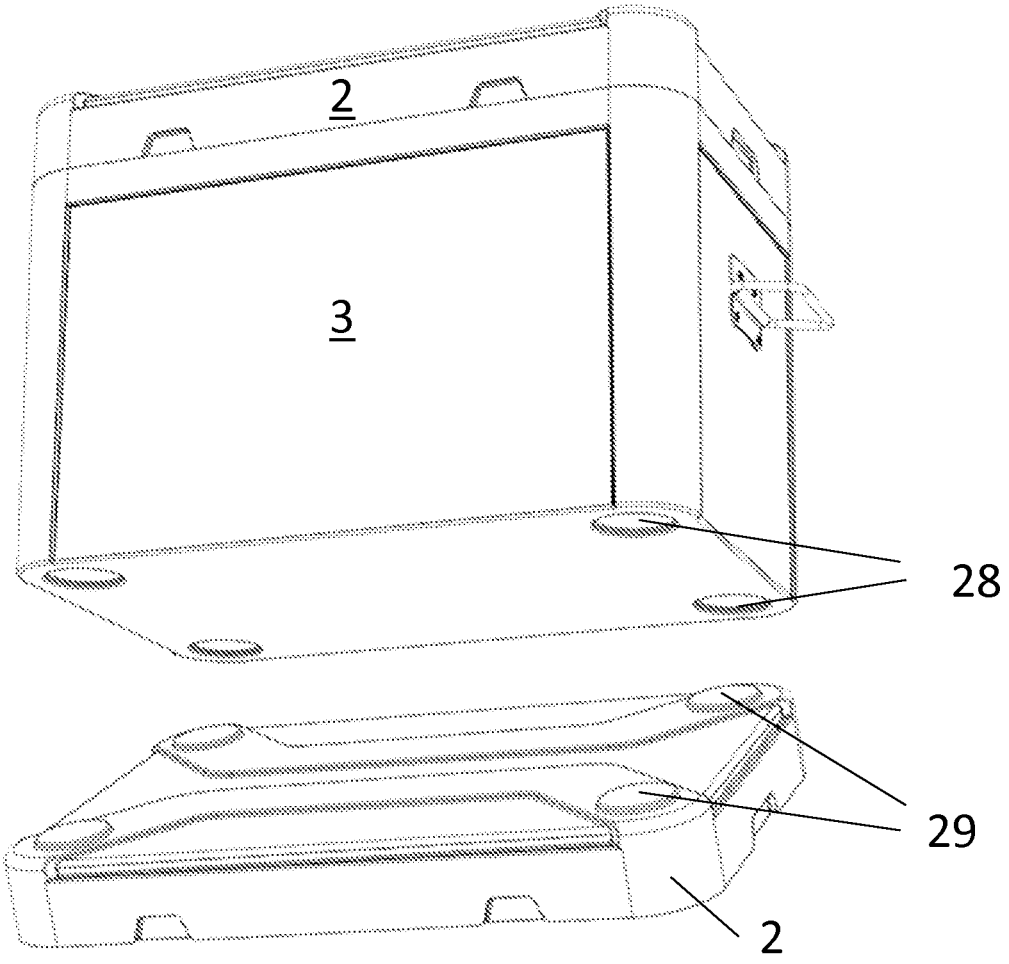
FIG. 14 shows a thermally insulated transport box.

FIG. 14 shows a thermally insulated transport box showing the outer surface of the bottom wall 7 of the box body 3 and an outer upper surface of the cover 2. The outer upper surface of the cover 2 comprises extending portions 28 and the outer surface of the bottom wall 7 comprises recesses 29. The extending portions 28 of the cover 2 are arranged to be coupled with corresponding recesses 29 of outer surface of the bottom wall 7. If two insulated thermal transport boxes 1 are stacked one above the other the coupling provides support against transversal movement. The extending portions 28 are preferably flat and shallow.

In FIGS. 10-13 shown partition wall 22*b*, which is a cold or heat accumulator, is shown in FIGS. 15-24 and described in detail below.

Figure 19:
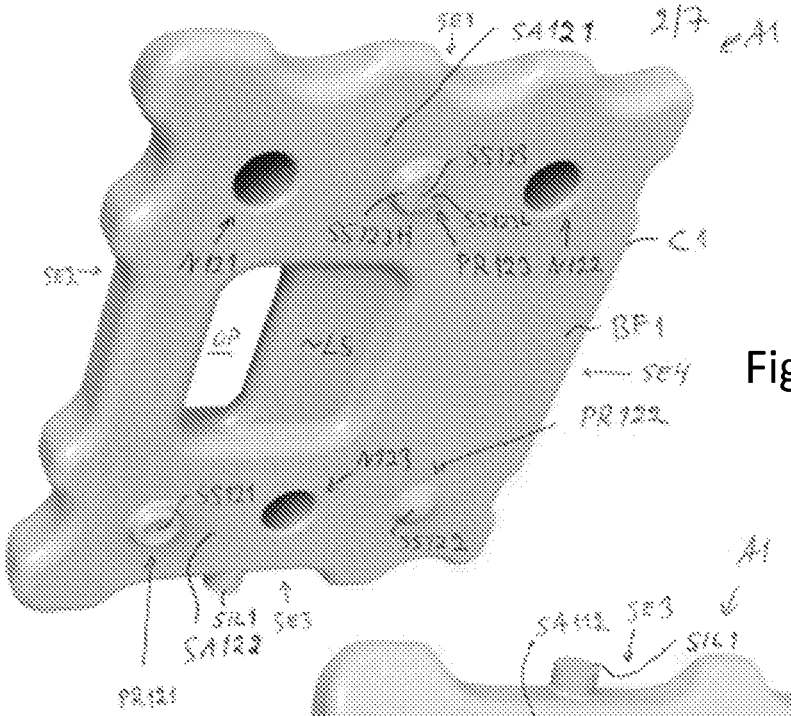
FIG. 19 shows a perspective view of especially the back (rear) face of the cold or heat accumulator of FIGS. 15-18, when also rotated in planar way 180 degrees.
Figure 20:
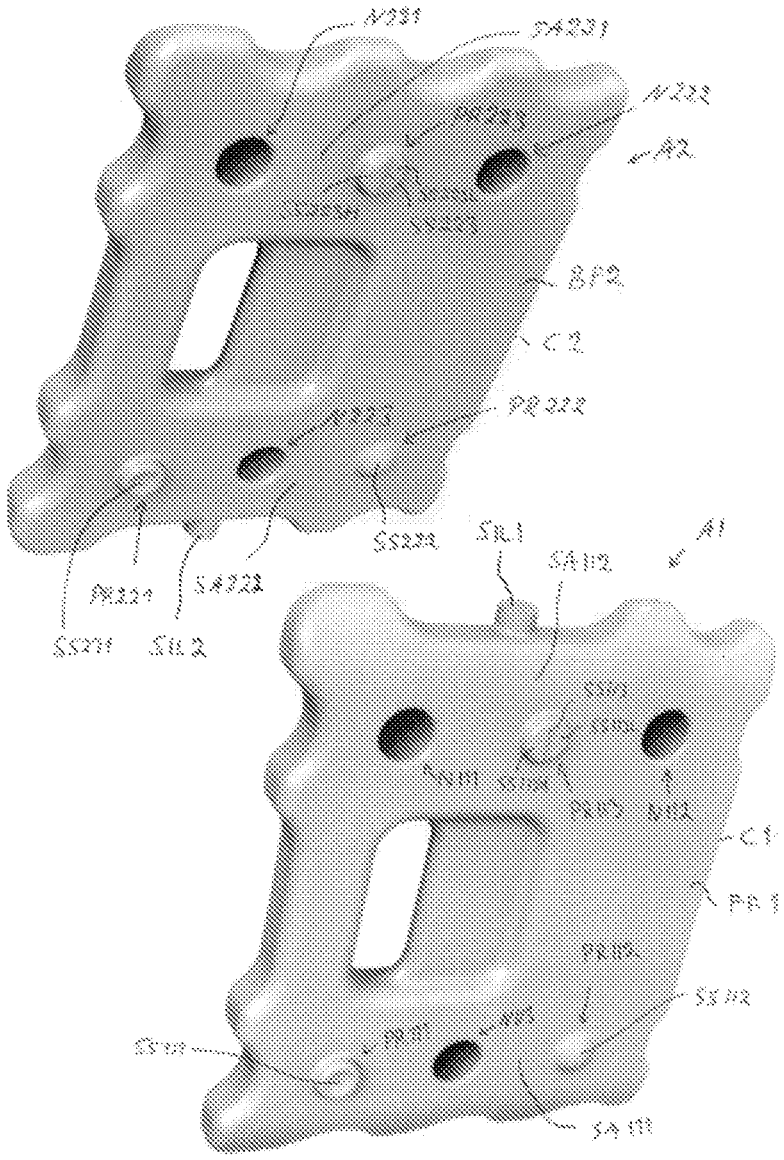
FIG. 20 looks similar to combination of FIGS. 18-19 but FIG. 20 shows two similar cold or heat accumulators in such way that the upper one of the two so the second cold or heat accumulator has been flipped 180 degrees in relation to horizontal axis to show the rear side of the second cold or heat accumulators.
Figure 21:
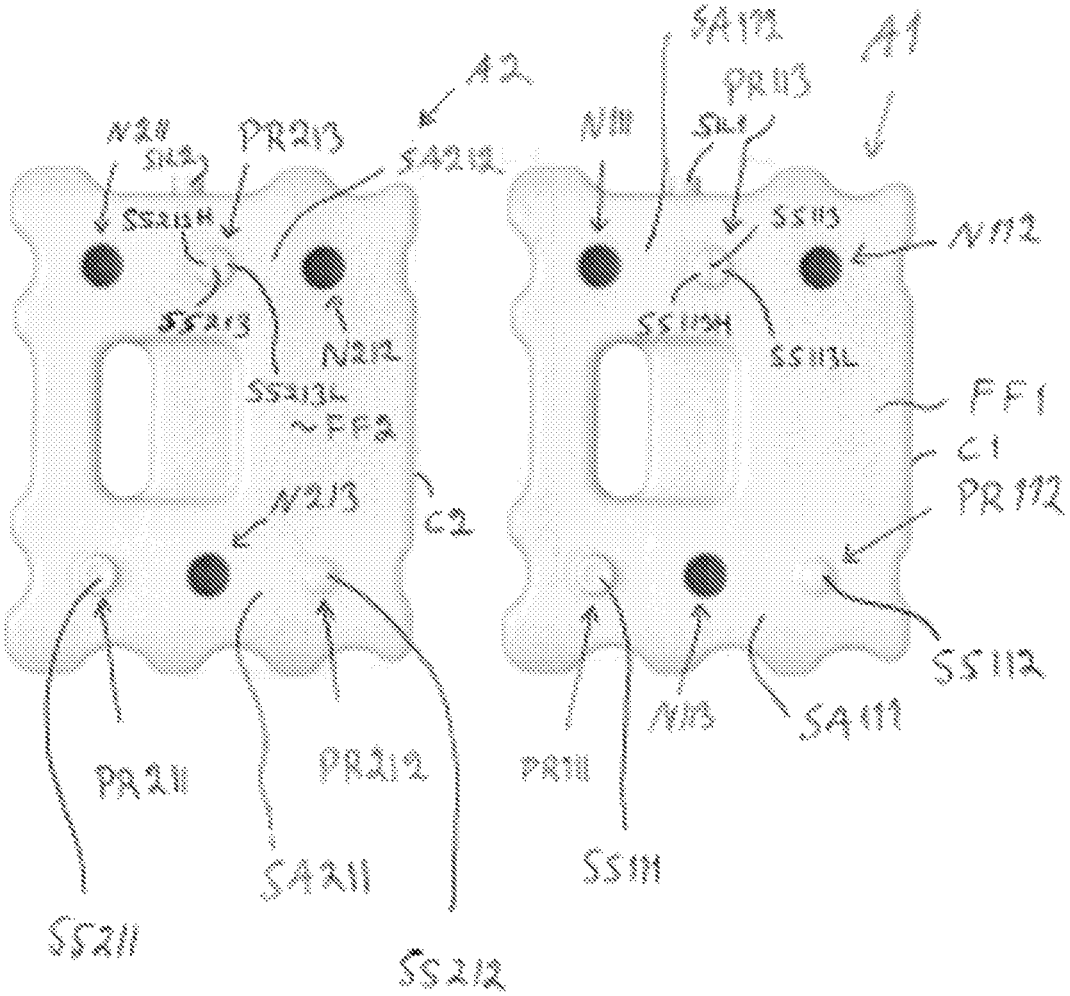
FIG. 21 shows the front faces of two similar cold or heat accumulators, as shown in FIG. 15.

Referring especially to FIGS. 15-19, lower parts of FIGS. 20, 22-24 and to the right side of FIG. 21, there is a accumulator A1 such as cold accumulator A1 comprising a container C1 for phase-change material PCM. PCM can be or contain water, gel, glycol, ammonium, paraffin or powder, for example. For a cold accumulator, the material has an ability the get frozen and to melt from the frozen state. For a heat accumulator, the material inside the container has ability to store heat and to release it. Preferably, container C1 is a plastic container.

In FIGS. 15-24 shown cold or heat accumulator A1, A2 comprises notches 12 in its opposing edges 13. As the cold or heat accumulator A1,A2, i.e. the partition wall 22*b*, is positioned to cover at least part of the opening 6 of the thermally insulated transport box 1 the cold or heat accumulator A1,A2 is supported by the half columns 9*a-b*. The cold or heat accumulator A1,A2 rests on the ends of the half columns 14. At least part of the notches 12 align with gaps 10*a* between the half columns 9*a* projecting from the side wall 4 to form an air flow path.

The notches 12 of the cold or heat accumulator A1,A2 shown in FIGS. 15-24 comprise a curved shape to surround the outer surface of the half column 9*a-b* when the cold or heat accumulator A1,A2 is installed above the bottom wall 7 to the lower part of the box body 3.

The cold or heat accumulator A1,A2 is slidable in vertical direction between two adjacent half columns 9*a* projecting from a side wall 4. When assembled the cold or heat accumulator A1,A2 extends between the two opposing side walls 4 forming a separating wall whereby creating two adjacent spaces 20*c-d* to the box body 3. The half columns 9*a* projecting from the first side wall 4 support the first end of the cold or heat accumulator A1,A2 and the half columns 9*a* projecting from the second side wall 4 support the second end of the cold or heat accumulator A1,A2. The half columns 9*a* keep the cold or heat accumulator A1,A2 in an upright position. Preferably, a tight stack, i.e. the face of the container of the accumulator is arranged to be against the face of another accumulator, comprising two stacked cold or heat accumulators fits between two adjacent half columns.

As the air cools around the cold or heat accumulator A1,A2, i.e. the partition wall 22*b*, it flows downwards along the formed flow path through the opening provided by the notch 12 and a gap 10 between two adjacent half columns 9*a,b* and further down along the gap between two adjacent half columns 10.

The container C1 of the first accumulator A1 comprises a front face FF1, a back face BF1 on the rear side of the container C1 and side ends SE1-SE4 between the front face FF1 and the back face BF1.

On the front face FF1 and on the back face BF1, the container C1 comprises protrusions and nests.

On the front FF1 face of the container C1, there are three protrusions PR111-PR113, so that protrusions PR111, PR112 are on the first (in FIGS. 15 and 18 the lower) surface area SA111 and a third protrusion PR113 is on the second (in FIGS. 15 and 18 the upper) surface area SA112. Also, there are three nests (recesses), so nests N111-N112 are on the second surface are a SA112 and a third nest N113 is on the first surface area SA111.

Referring to FIG. 19, showing the back (rear) face BF1 of the accumulator A1: Correspondingly in the back (rear) face BF1 of the container C1 of the first accumulator A1, there are three protrusions PR121-PR123, so that protrusions PR121, PR122 are on the second (in FIG. 19 the lower) surface area SA122 of the back face BF1 and a third protrusion PR123 is on the first (in FIG. 19 the upper) surface area SA121 of the back face BF1. Also, there are three nests (recesses) N121-N123, so nests N121-N122 are on the first surface area SA121 of the back face BF1 of the accumulator A1 and a third nest N123 is on the second surface area SA122 of the back face BF1 of the accumulator A1.

Figure 22:
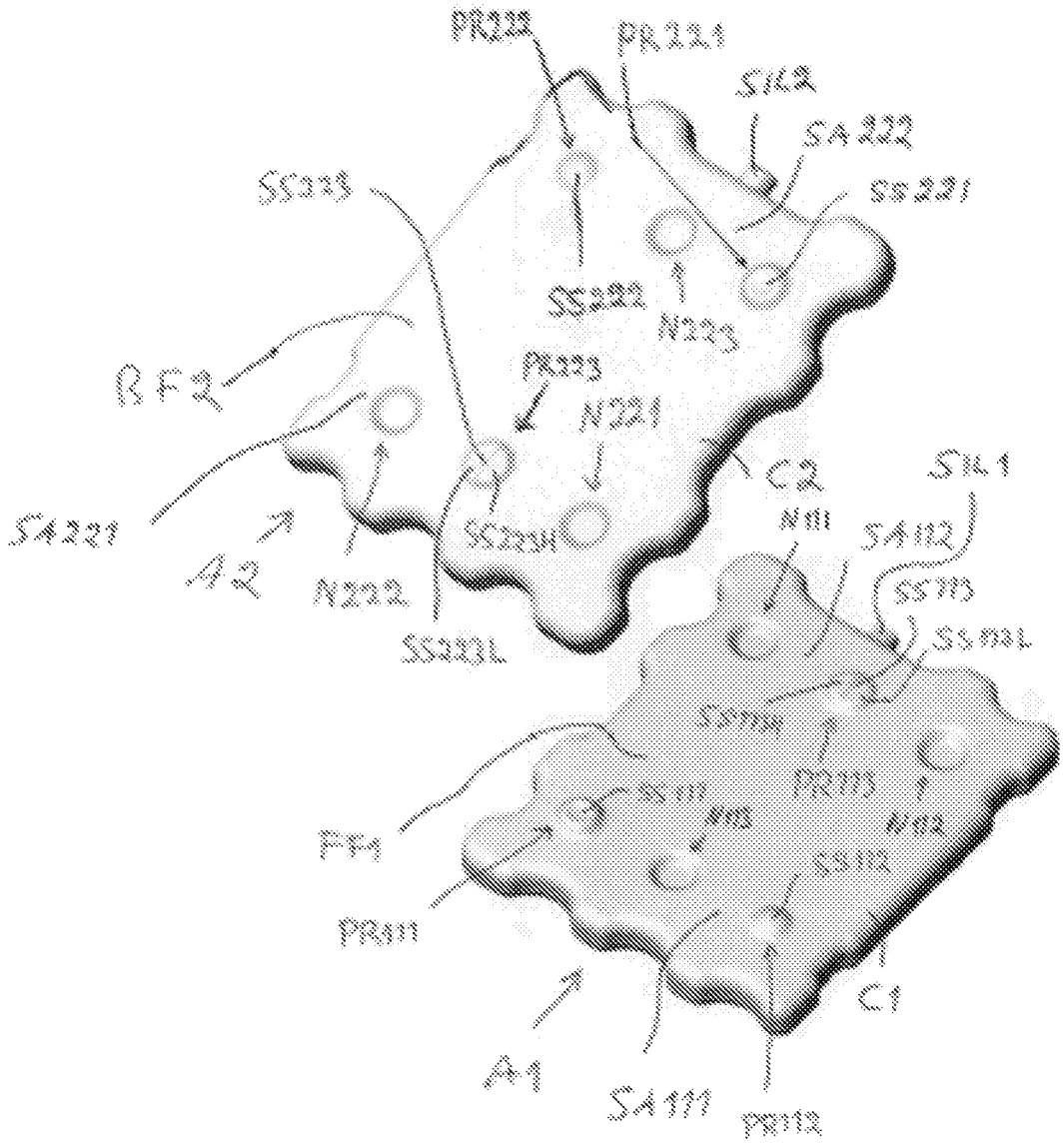
FIG. 22 shows two similar cold or heat accumulators in such way that the upper one of the two so the second cold or heat accumulator has been flipped 180 degrees in relation to vertical axis to show the rear side of the second cold or heat accumulator.

Regarding the second freeze accumulator A2 having a container C2, the front face FF2 of the accumulator A2 is shown in the left side of the FIG. 21, and the back (rear) face BF2 of the accumulator A2 is shown in the upper part of FIGS. 20 and 22. Therefore, regarding the protrusions and nest, on the front face FF2 of the container C2 of the second accumulator A2, there are three protrusions PR211-PR213, so that protrusions PR211, PR212 are on the first (in FIG. 21 lower) surface area SA211 and a third protrusion PR213 is on the second (in FIG. 21 the upper) surface area SA212. Also, on front face FF2 of accumulator A2 there are three nests (recesses) N211-N213, so nests N211-N212 are on the second surface area SA212 and a third nest N213 is on the first surface area SA211.

Referring to the back face BF2 of second accumulator A2 shown in upper part of FIGS. 20 and 22, correspondingly in the back (rear) face BF2 of the container C2 of the second accumulator A2, there are three protrusions PR221-PR223, so that protrusions PR221, PR222 are on the second surface area SA222 and a third protrusion PR223 is on the first surface area SA221 of the back face BF2. Also, there are three nests (recesses) N221-N223, so nests N221-N222 are on the first surface area SA221 of the back face BF2 of the accumulator A2 and a third nest N223 is on the second surface area SA222 of the back face BF2 of the accumulator A2.

Figure 23:
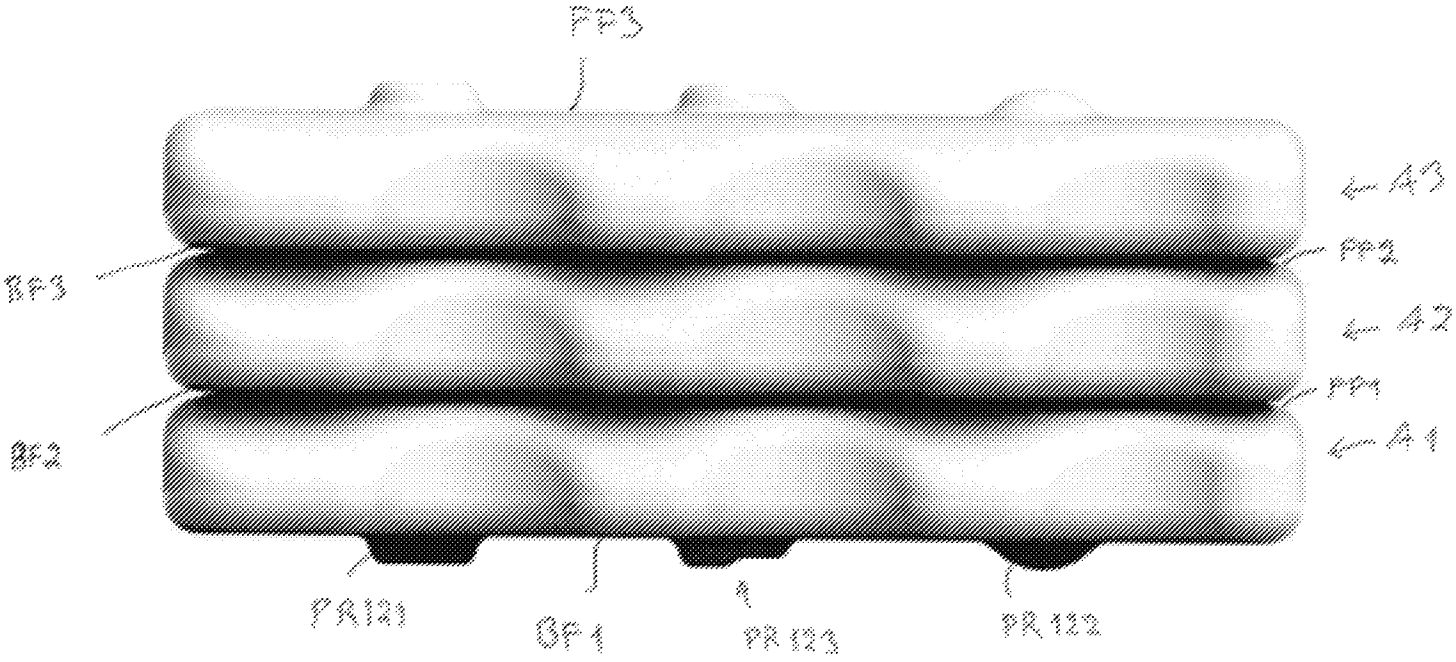
FIG. 23 shows the use-mode where the already frozen/heated cold or heat accumulator are in a tight stack without gaps.
Figure 24:
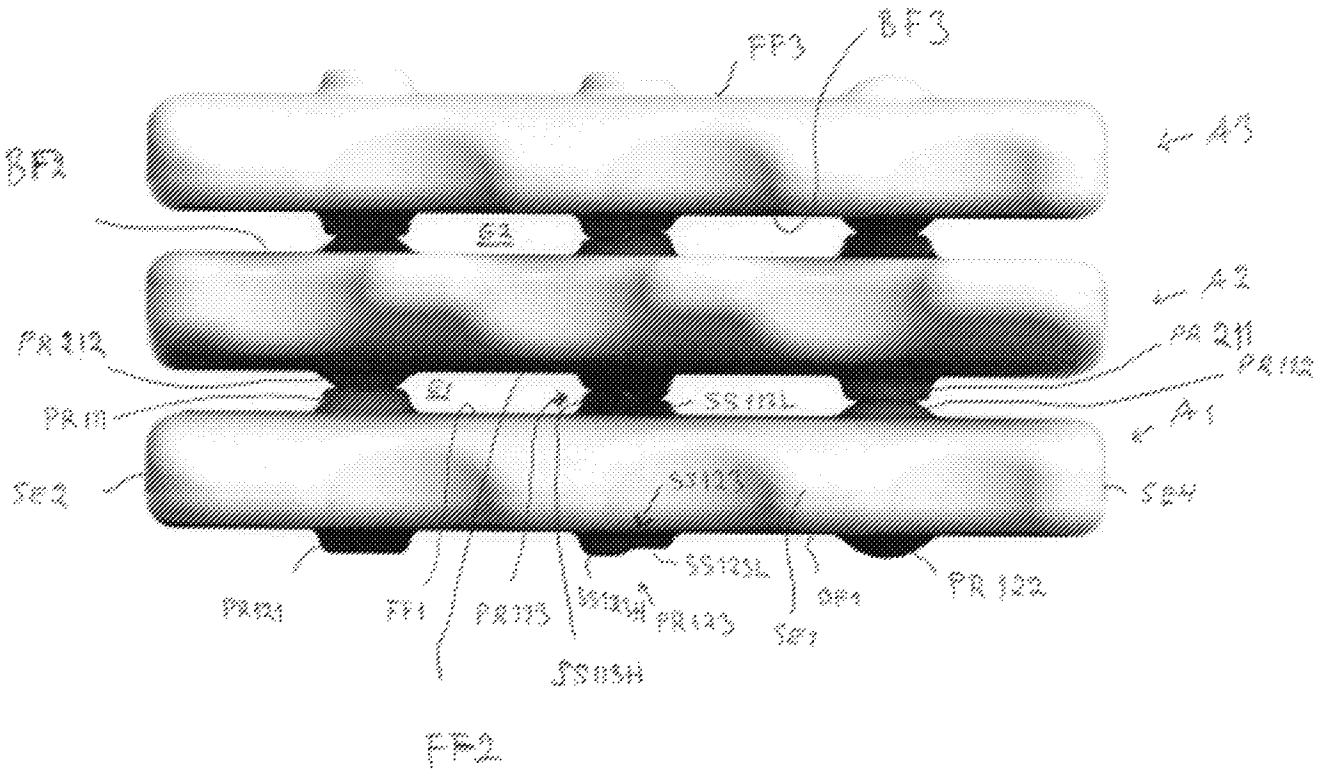
FIG. 24 shows the to be freezed/to be heated-mode (air gap-mode) where the stack includes gap between each two cold or heat accumulator.

Regarding FIGS. 23-24, the invention makes it possible to stack large amount, for example ten, accumulators on two different kind of stacks. FIGS. 23-24 show stacks having three accumulators A1-A3. Regarding the second accumulator A2 shown in upper part of FIGS. 20 and 22 and on the left side of FIG. 21 and regarding the first accumulator A1 shown in FIGS. 15-22. When there is a desire to have a tight gapless stack according to FIG. 23 having at least three stacked accumulators A1-A3, we can say that protrusions PR111-PR113 of accumulator A1 are arranged to be coupled with the nests N221-N223 of the accumulator A2, and the nests N111-N113 of the accumulator A1 are arranged to be coupled with the corresponding protrusions PR221-PR223 of accumulator A2, so as to form a use-position where the face of the container of the freeze accumulator A1 is arranged to be against the face of said another accumulator A2. In FIG. 23, face of the container C2 of the freeze accumulator A2 is arranged to be against the face of the container C1 of accumulator A1 and other face of accumulator A2 is against the face of the accumulator A3. Above, "use-position" refers to a tight stack of accumulators that keeps the coolness/coldness more efficiently because the frozen freeze accumulators are tightly combined without gaps. Referring to FIGS. 20-21, this suitable relative position of accumulators A1, A2 can be reached by stacking accumulator A2 on top of accumulator A1 so that protrusion PR221 meets nest N111, protrusion PR222 meets nest N112, protrusion PR223 meets nest N113. Correspondingly, protrusions PR111-PR113 of accumulator A1 meet the nests N221-N223 of the accumulator A2. Similar tight/gapless combination of accumulators A1, A2 can be done by just putting accumulator A2 of FIG. 16 on top of accumulator FIG. 15. In FIG. 23, the accumulators A1-A3 are arranged in such way that bottom face of an accumulator is against the front face of the next/parallel accumulator. For example, bottom face BF2 of the second accumulator A2 is against the front face FF1 of the first accumulator A1, and bottom face BF3 of the third accumulator A3 is against the front face FF2 of the second accumulator A2.

Referring to FIGS. 15-21, on both on the front face FF1 and on the back face BF1 (shown in FIG. 19) of the accumulator A1, the protrusions and nests are arranged in groups in such way that first group, which is at the first surface area SA111 of the respective face FF1 of the container C1, comprises at least three members including at least two protrusions PR111, PR112 and at least one nest N113. Additionally, the second group, which is at the second surface area SA112 of the respective face FF1 of the container C1, comprises at least three members including at least two nests N111, N112 and at least one protrusion PR113. The above related to front face FF1 of accumulator A1.

Correspondingly in FIG. 19, relating now to back face BF1 of the accumulator A1, the protrusions and nests are arranged in groups in such way that second group, which is at the second surface area SA122 of the respective back face BF1 of the container C1, comprises at least three members including at least two protrusions PR121, PR122 and at least one nest N123. Additionally, the first group, which is at the first surface area SA121 of the respective face BF1 of the container C1, comprises at least three members including at least two nests N121, N122 and at least one protrusion PR123.

The above configuration of protrusions and nests is true also for the other accumulators A2-A3.

If the accumulators A1-A2 of FIG. 20 would be stacked as is shown in FIG. 23, then in FIG. 20 the back face BF2 of the accumulator A2 would be set against front face FF1 of accumulator A1. In that position the two nests N221, N222 and one protrusion PR223 locating at the first surface area SA221 of the back face BF2 of the accumulator A2 are arranged to engage their counterparts so two protrusions PR111, PR112 and one nest N113 locating at the first surface area SA111 of the front face FF1 of the accumulator A1. That would be the use-position so a tight stack without gap between the accumulators because the tight stack is able to keep the stored cold (or stored heat) over longer time.

Compared to above, regarding a different position (according to FIG. 24) of each two accumulators, and referring to FIGS. 20-21 and 18-19, the accumulator A2 shown FIGS. 20-21 would first be turned/rotated 180 degrees around the vertical (longitudinal) axis of the accumulator A2, and because of that then the front face FF2 (shown in left side of FIG. 21) of accumulator A2 would be arranged against the front face FF1 of the accumulator A1. Referring especially to 24 (and also to FIG. 21 after turning accumulator A2 around the longitudinal axis), when the accumulator A2 is arranged to be in a turned position (in relation to above mentioned use position of FIG. 23 without gaps between accumulators) compared to said another freeze accumulator A1, the protrusions PR111, PR112, PR113 at the first surface area SA111 at the front face FF1 of the accumulator A1 are arranged against the protrusions PR212, PR211, PR213 at the first surface area SA211 of the of the second accumulator A2. This is a to be freezed-mode (or to be heated mode if a heat accumulator) where the face FF1 of the freeze accumulator A1 is arranged to be remote from the face FF2 of said another freeze accumulator A2 and thereby providing a freezing gap (or a heating gap if heat accumulator) G1 between the face FF1 of the accumulator A1 and the face FF2 of said another accumulator A2. Therefore, protrusion PR111 is engaged/coupled with (set against) protrusion PR212, protrusion PR112 is engaged/coupled with (set against) protrusion PR211, protrusion PR113 is engaged/coupled with (set against) protrusion PR213. Air gap-mode refers to both the to be freezed mode and the to be heated mode.

When creating the stacks with gaps G1-G2, there is also an alternative to already mentioned turning/flipping the accumulator (like A2) 180 degrees around the longitudinal axis of the accumulator, as was shown in FIG. 24 This alternative is planar 180 degree rotation of accumulator A2, compared to next/parallel accumulators A1, A3. In that case the accumulators A1-A3 would not be like in FIG. 24 where front face FF1 of accumulator A1 is facing (with a gap G1) front face FF2 of next parallel accumulator A2 (or bottom face BF2 of accumulator A2 facing, with a gap G2 bottom face BF3 of accumulator A3), but instead the front face FF1 of the accumulator A1 would be facing (with a gap) back face (lower face) BF2 of the accumulator A2, and front face FF2 of the accumulator A2 would be facing (with a gap) back face (lower face) BF3 of the accumulator A3.

The configuration of protrusions and nests in accumulators A2-A3 are as disclosed regarding the accumulator A1.

Regarding the protrusions and nests, the interrelation between accumulators A2 and A3 is as disclosed regarding the interrelation between accumulators A1 and A2.

In FIG. 24, corresponding to freezing gap G1 (heating gap), the freezing gap between accumulators A2 and A3 is marked with G2. For example, the height of the gap is preferably at least 10 mm. The height of the protrusions, like PR111-PR113, PR211-PR223, is preferably at least 6 mm. Even though in the to be freezed (or to be heated)-mode (having gaps G1, G2 as shown is FIG. 24), when each two 6 mm high protrusions of two accumulators A1, A2 (or A2, A3) are coupled (in contact, set against), the gaps are not 12 mm but 10 mm because, as will be later explained, protrusions PR111, PR113 at the front face FF1 of accumulator A1 contain recesses so that the counterpart protrusions PR212, PR213 on the front face FF2 of accumulator A2 can extend about 2 mm (or any other suitable amount) to the protrusions PR111, PR113.

Referring to above, when wishing to create stack with gaps G1, G2 as shown in FIG. 24, the above mentioned turning (compared to use-position of FIG. 23) of the accumulator can one or more of the following: rotating 180 degrees in planar way (so not rotating around the axis of the accumulator) or alternatively rotating/flipping 180 degrees around longitudinal axis of the accumulator.

Longitudinal axis is running in the vertical direction in FIGS. 15-16 and towards the viewer in FIGS. 23-24, and it is transversal compared to direction of group of protrusions/nest at area SA111 having protrusion PR111, nest N113 and protrusion PR112, and the longitudinal axis is also transversal compared to direction of group of nests/protrusion at area SA112 having nest N111, protrusion PR113 and nest N112.

As stated above, protrusions and nests are arranged in groups in such way that first group, which is at the first surface area SA111 of the respective face FF1 of the container C1, comprises at least three members including at least two protrusions PR111, PR112 and at least one nest N113. Additionally, the second group, which is at the second surface area SA112 of the respective face FF1 of the container C1, comprises at least three members including at least two nests N111, N112 and at least one protrusion PR113. Referring to this, there are the following preferred embodiments.

In an embodiment, on the face FF1 of the container C1 the first group located on said first surface area SA111 and the second group located on said second surface area SA112 are next to different side ends SE1-SE4 of the container. In a further specified embodiment as shown in figures, on the face FF1 of the container C1, the first group locating on said first surface area SA111 and second group locating on said second surface SA112 area are next to opposing side ends SE1, SE3 of the container C1. In a further embodiment, on the face FF1 of the container C1, the first group locating on said first surface area SA111 and second group locating on said second surface area SA112 are parallel with each other. In other words the line/row comprising protrusion PR111, nest N113 and protrusion PR112 is parallel with the line/row comprising nest N111, protrusion PR113 and nest N112.

The same is true also at the back (rear) face BF1 shown in FIG. 19. Therefore, on the back face BF1 the first group locating on said first surface area SA121 at back face BF1 and second group locating on said second surface SA122 area are next to opposing side ends SE1, SE3 of the container C1. In a further embodiment, on the face BF1 of the container C1, the first group locating on said first surface area SA121 at back face BF1 and second group locating on said second surface area SA122 are parallel with each other. In other words the line/row comprising protrusion PR121, nest N123 and protrusion PR122 is parallel with the line/row comprising nest N121, protrusion PR123 and nest N122.

Referring especially to FIG. 19, showing both faces FF1, BF1 of accumulator A1. To have mirror symmetry and easy adaptability, in an embodiment, the accumulator A1 is such that at positions where on the front face FF1 of the container there are protrusions like PR111-PR113, there are nests N121, N122, N123 on the back face BF1 of container C1. And correspondingly, at positions where on the front face FF1 of the container C1 there are nests N111-N113, there are protrusions PR121, PR122, PR123 on the back face BF1 of container C1.

In this context it is important to understand that even though FIGS. 16-17 would with a quick look try to refer that there are protrusions at same location at both faces FF1, BF1, this is not true because it is important to understand that the protrusions in FIGS. 16-17 are not at same distance from the viewer.

In an embodiment, one or more protrusion, such as PR111, PR113 comprise a support structure SS111, SS113 for positioning the protrusion of the accumulator A1 against the protrusion of another accumulator A2, so as the create support against transversal movement of the accumulators A1, A2. In a further embodiment, at least three protrusions (on each face), such as PR111-PR113, PR121-PR123 comprise support structure thereof.

Figure 18:
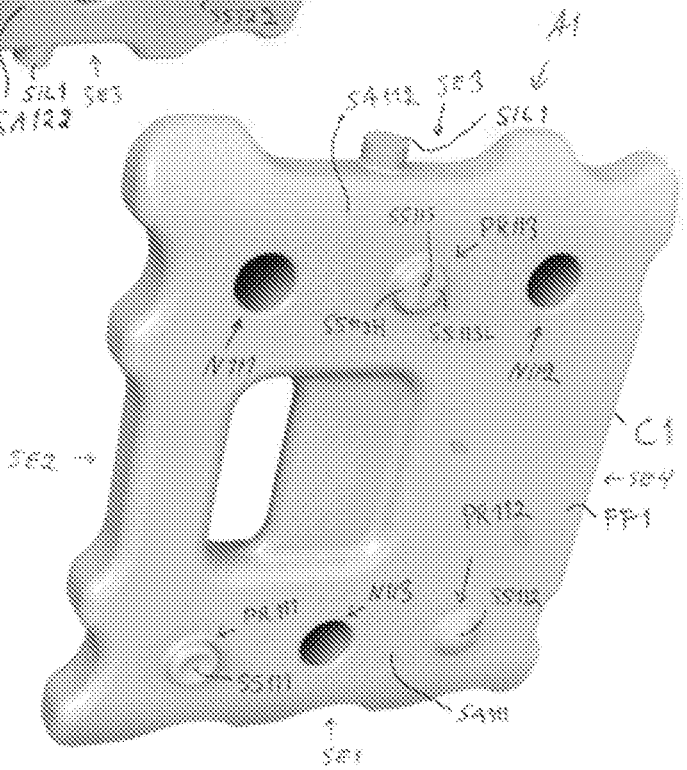
FIG. 18 shows a perspective view showing especially the front face, of the cold or heat accumulator of FIG. 15.

On the front face FF1, as can be seen from example from the FIGS. 18-19, the protrusions PR111-PR113 have protrusion-specific support structure SS111-SS113 having different shape than the other support structure in one or more protrusion PR111-PR113. Similarly, on the back face BF1 there are support structures SS121-SS123 on the protrusions PR121-PR123.

For example, regarding FIGS. 18-19, on the front face FF1 of the accumulator A1, the support structure SS111 is a wall of the hollow space (recess) at the end face of the protrusion PR111 at front face FF1. Correspondingly, support structure SS121 is a wall of the hollow space (recess) at the end face of the protrusion PR121 at the back face BF1. Regarding the to be freezed/heated-position with gaps G1, G2, shown in FIG. 24 and regarding FIG. 21 when accumulator A2 will be rotated 180 degrees around longitudinal (vertical) axis so that front face FF2 of accumulator A2 will be facing the front face FF1 of the accumulator A1: Recess with a wall SS111 (a support structure SS111 for positioning/centering/concentrating) on the end face of the protrusion PR111 on front face FF1 of the container C1 is then co-operating (engaged, connected, coupled, set against) with a curved protrusion PR212 at the front face FF2 of accumulator A2, and the curved protrusion PR112 is co-operating (engaged, connected, coupled, set against) with the recess-wall SS221 (a support structure SS212 for positioning/centering/concentrating) of the protrusion PR211 on the front face FF2 of the accumulator A2.

Regarding FIGS. 20-22, also the protrusions of the second accumulator A2 have support structures SS221-SS223, SS211-SS213. The support structures SS221-SS223 are at the end face of the protrusions PR221-PR223 on the back face BF2 of the accumulator A2, as shown in upper part of FIG. 20. The support structures SS211-SS213 are at the end face of the protrusions PR211-PR213 on the front face FF2 of the accumulator A2, as shown in left part of FIG. 21. Support structure SS211 on protrusion PR211 in FIG. 21 and support structure SS221 on protrusion PR221 are like the earlier mentioned recess-walls SS111 and SS121 in FIG. 19.

If recess-wall SS111 at the end face of protrusion PR111 at front face FF1 of accumulator A1 is regarded as first type of positioning structure, then the curved shape SS112 of protrusion PR112 can be regarded as second type of support structure for positioning, because it co-operates with recess-wall SS221 of protrusion PR221 at accumulator A2.

Referring to FIGS. 18-22, a third type of support structure is discussed in the following. On the front face FF1, third type of support structure is according to an embodiment, wherein one or more support structure is a step structure SS113 comprising a lower step SS113L and a higher step SS113H at the end face of the protrusion PR113. On the back face BF1 of the accumulator A1, there is a similar step structure SS123 at the end face of the protrusion PR123, this step structure SS123 comprises a lower step SS123L and a higher step SS123H at the end face of the protrusion PR123. As a counterpart for step structure SS113 at the protrusion PR113 at the front face FF1 of the accumulator A1, the second accumulator A2 comprises step structure SS223 that is at the end face of the protrusion PR223, and likewise this step structure SS223 comprises lower step SS223L and a higher step SS223H at the end face of the protrusion PR223.

As can be seen from FIG. 24, and also from the shape of step structures SS113 and SS223, the higher step S113H at protrusion PR113 at the accumulator A1 is coupled (engaged, connected, set against) with the lower step SS213L that is at the protrusion PR213 at the front face FF2 of second accumulator A2. Correspondingly, the lower step S113L at protrusion PR113 at the accumulator A1 is coupled (connected, set against) with the higher step SS213H that is at the protrusion PR213 at the front face FF2 of the second accumulator A2.

Since the protrusions and steps thereof extend in the vertical direction, the "higher" and "lower" are to be understood as compared to the surface of the container, not to understood as which step in higher from the ground.

Referring to FIGS. 15 and 18-22 in an embodiment, in the second group, which is at the second surface area SA112 of the respective face FF1 of the container C1, the protrusion PR113, having a step structure SS113H, SS113L as a support structure SS113, is located between the two nests N111, N112. Furthermore, in first group, which is at the first surface area SA111 of the respective face FF1 of the container C1, the nest N113 is between the two protrusions PR111, PR112. Similar principle is at the mirror-like back side BF1 of the accumulator A1.

Yet another feature highlighting the mirror-symmetry of the configuration of protrusions and nests is as is described in an embodiment: At the same longitudinal line on which there is a protrusion in the first group at the first surface area SA111 of the respective face FF1 of the container C1, there is a nest at the second group at the second surface area of the respective face of the container. In other words, at the same longitudinal line there is protrusion PR111 and nest N111, and at the same longitudinal line there is protrusion PR112 and nest N112. Correspondingly, at the same longitudinal line on which there is a nest N113 in the first group at the first surface area SA111 of the respective face FF1 of the container C1, there is a protrusion PR113 at the second group at the second surface area.

Regarding an additional role for the protrusions, in an embodiment, protrusions provide an air gap in relation to bottom wall or other wall of the box into which box the freeze accumulator is inserted.

The above configuration of protrusions and nests is true also for the other similar accumulators A2-A3.

Referring to FIG. 19, in an embodiment, the container C1 of the accumulator comprises a lifting structure LS for one or more fingers of the user. Lifting structure LS is a surface area within the container wall or surrounded by the container wall, and that surface area so the lifting structure LS is located higher than the back/rear face BF1 of the container. Next to the lifting structure LS or surrounded by the lifting structure LS there is a through-going opening OP for one or more fingers. When the accumulator is supported on the bottom of a box (for accumulators) or on top of another accumulator, the height related location of the lifting structure LS creates empty space for fingers under the lifting structure.

The above mentioned structures are suitable for not only cold accumulators but also for heat accumulators.

In the figures, SIL1 and SIL2 refer to sealed/closed input that has been used when filling the containers C1, C2 with phase-change material.

The disclosed embodiments relate to accumulator where the basic shape of the accumulator and especially the setting, formed from the location of groups having protrusions/nest or nests/protrusion, is rectangular. However a square-based form is also possible, and in that case there is a group of protrusions/nest or a group of nests/protrusion that is transversely (about 90 degrees) oriented compared to other group having nests/protrusion or protrusions/nest. In that case, for an accumulator, a planar rotation of only about 90 degrees is suitable for creating the air gap-mode (for freezing or heating) where three protrusions of an accumulator meet the three protrusions of another accumulator. This kind of transversal group could be vertical i.e longitudinal in FIG. 15, and be next to side edges SE1 and/or SE4.

The element of the invention is that on same side (same face) of the accumulator there are two coupling element groups, next to edges SE1, SE3, at different surface areas SA111, SA112 on face FF1, those groups each having op-posed type of coupling elements (protrusion, nest) within a group and also when compared to the other group on that same face FF1. Group at area SA111 has two protrusions PR111, PR112 and a nest N113, and group at surface area SA112 has two nest N111, N112 and a protrusions PR113. Furthermore, there are corresponding groups also at the back face BF1, but the groups are next to different edges (SE3, SE1) compared where the groups are (next to edges SE1, SE3) on the front face FF1, so in other words: when at the front face FF1 on the first surface area SA111 next to edge SE1 there are in a group two protrusions PR111, PR112 and a nest N113, then at the back face BF1 on the second surface area SA122 next to edge SE3 there are in a group two protrusions PR121, PR112 and a nest N112.

Correspondingly, when at the front face FF1 on the second surface area SA112 next to edge SE3 there are in a group two nests N111, N112 and a protrusion PR113, then at the back face BF1 on the first surface area SA121 next to edge SE1 there are in a group two nests N121, N122 and a protrusion PR123. The distance between groups is the same on both faces FF1, BF1.

The above refers also to that at positions where on the front face FF1 of the container there are protrusions PR111-PR113, there are nests N121-N123 on the back face BF1 of container C1, and correspondingly, at positions where on the front face FF1 of the container C1 there are nests N111-N113, there are protrusions PR121-PR123 on the back face BF1 of container C1.

Examples of materials suitable for manufacturing material of the thermally insulated transport box are expanded polypropylene (EPP), expanded polystyrene (EPS) or polyurethane (PUR). The outer surface of the thermally insulated transport box 1 can also be painted with a heat reflective paint in order to reduce ambient heat load. Further, a coating can be applied to the outer surface of the thermally insulated transport box 1 to prevent the box from denting and scratching. The coating can also reduce ambient heat load by reflecting. Additionally, an antimicrobial coating can be applied to the interior face or/and the outer surface of the thermally insulated transport box.

National hygiene legislation in various counties often allow that perishable foodstuffs may temporarily be sold and stored in an isolated container containing a lid closing the container when the container includes a cold accumulator, or even without a cold accumulator if the storage temperature remains below a legal maximum due to the existing ambient temperature. Perishable foods are those likely to spoil, decay or become unsafe to consume if not kept at chill temperatures below a legal maximum. Examples of perishable foods are meat, poultry, fish and dairy products. Typical legal maximum temperature for perishable foods is 0-8° C. The thermally insulated transport box 1 of the can be used for temporary storing of perishable foodstuffs. Preferably the phase change material has a melting temperature at a temperature range −2° C. . . . 2° C.

It will be obvious to a person skilled in the art that, as the technology advances, the inventive concept can be implemented in various ways. The invention and its embodiments are not limited to the examples described above but may vary within the scope of the claims.

List of parts: 1 a thermally insulated transport box; 2 a cover; 3 a box body; 4 a side wall; 5 an end wall; 6 an opening; 7 a bottom wall; 8 a flange; 9*a-b* a half column; 10*a-b* a gap between half columns; 11 a separating partition; 12 a notch; 13 an edge; 14 an end of a half column; 15 transported goods; 16 a cold or heat accumulator; 17 a hole; 18 a protrusion in a bottom wall; 19*a-b* a gap between rows; 20*a-d* a space; 21 a lip part; 22 a partition wall; 23 a temperature monitoring device; 24 a mounting tray; 25 fixing point; 26 a carrying member. 27 a projecting part; 28 an extending portion; 29 a recess; A1,A2, A3 a cold or heat accumulator; BF1, BF2, BF3 a back face; C1,C2 a container; FF1, FF2, FF3 a front face; G1,G2 an air gap; L lengthwise direction; LS a lifting structure; N111-N113, N121-N123, N221-N223 a nest; OP a through-going opening; PR111-PR113, PR121-PR123 a protrusion; SA111,SA121 a first surface area; SA112, SA122 a second surface area; SE1-SE4 a side end; SIL1,SIL2 an input; SS111-SS113, SS121-SS123 a support structure; w crosswise direction.

The invention claimed is:

1. A thermally insulated transport box, the thermally insulated transport box comprising a cover and a box body, the box body further comprising side walls, end walls, an opening and a bottom wall, wherein inner surfaces of the side walls comprise half columns projecting from the side wall, inner surfaces of the end walls comprise half columns projecting from the end wall, and the half columns run vertically along the side walls and along the end walls, the thermally insulated transport box further comprises at least one partition wall in the form of a cold or heat accumulator comprising notches in its opposing edges and protrusions and nests on a front face and on a back face of the cold or heat accumulator, said protrusions being arranged to be coupled with corresponding nests of an another accumulator, and said nests being arranged to be coupled with corresponding protrusions of said another accumulator so as to form a use-mode where a face of the accumulator is arranged to be against the face of said another accumulator, the at least one partition wall in the form of the cold or heat accumulator is positionable to an upper part of the box body to cover at least part of the opening, the same partition wall is positionable between adjacent half columns to form a separating wall for creating two horizontally adjacent spaces and the same partition wall is positionable to a lower part of the box body on the bottom wall, the partition wall positionable to the upper part of the box body is supported by the half columns and at least part of the notches of the partition wall align with gaps between the half columns projecting from the side wall to form an air flow path, and the cold or heat accumulator comprising a container for phase-change material.

2. The thermally insulated transport box according to claim 1, wherein both on the front face and on the back face of the cold or heat accumulator, the protrusions and nests are arranged in groups in such way that first group, which is at the first surface area of the respective face of the container, comprises at least three members including at least two protrusions and at least one nest, and the second group, which is at the second surface area of the respective face of the container, comprises at least three members including at least two nests and at least one protrusion, so that when the accumulator is arranged to be in a turned position compared to said another accumulator, the protrusions of the accumulator are arranged against the protrusions of said second accumulator, so as to form an air gap mode, where the face of the accumulator is arranged to be remote from the face of said another accumulator and thereby providing an air gap (G1) between the face of the accumulator and the face of said another accumulator.

3. The thermally insulated transport box according to claim 1, wherein the thermally insulated transport box further comprises at least one separating partition comprising notches in opposing edges of the separating partition, and as the separating partition is positioned to cover at least part of the opening the separating partition is supported by the half columns and at least part of the notches align with gaps between the half columns projecting from the side wall to form an air flow path, and the same separating partition is positionable between adjacent half columns to form a separating wall for creating two horizontally adjacent spaces.

4. The thermally insulated transport box according to claim 3, wherein the same separating partition is positionable to form a supporting surface for one or more cold or heat accumulators, and to form a supporting surface for the transported goods in the lower part of the box body.

5. The thermally insulated transport box according to claim 3, wherein the separating partition comprises lip parts projecting from the edges, and as the separating partition is positioned to the lower part of the box body the lip parts touch the bottom wall and support the separating partition providing an air flow path between the bottom wall and the separating partition.

6. The thermally insulated transport box according to claim 1, wherein the bottom wall comprises a plurality of substantially hemispherically shaped protrusions.

7. The thermally insulated transport box according to claim 6, wherein at least part of the plurality of substantially hemispherically shaped protrusions are aligned in rows in a crosswise direction (w) of the bottom wall, and a gap between two adjacent rows and a gap between two adjacent half columns projecting from the side wall are located substantially at the same location in the lengthwise direction (L) of the box body.

8. The thermally insulated transport box according to claim 6, wherein the box body, the half columns and the plurality of substantially hemispherically shaped protrusions comprise same material and form a unitary piece.

9. The thermally insulated transport box according to claim 1, wherein at least part of the half columns projecting from the side walls extend from the bottom wall to the upper part of the box body.

10. The thermally insulated transport box according to claim 1, wherein the half columns projecting from the side wall project from the side wall by less than half diameter of the half columns.

11. The thermally insulated transport box according to claim 1, wherein as the partition wall is positioned to the lower part of the box body the notches align with the half columns to surround the half column.

12. The thermally insulated transport box according to claim 1, wherein the same partition wall is configured to be rotated between at least a first rotational orientation, in which the partition wall is positioned on the lower part of the box body on the bottom wall, and a second rotational orientation in which the partition wall is positioned on the upper part of the box body and is supported by the half columns, wherein the same partition wall is not positionable on the lower part of the box body when in the second rotational orientation and is not positionable on the upper part of the box body when in the first rotational orientation.

13. An arrangement in a thermally insulated transport box, the arrangement comprising a thermally insulated transport box, the thermally insulated transport box comprising a cover and a box body, the box body comprising side walls, end walls, an opening and a bottom wall, wherein inner surfaces of the side walls comprise half columns projecting from the side wall, inner surfaces of the end walls comprise half columns projecting from the end wall, and the half columns run vertically along the side walls and along the end walls, the thermally insulated transport box comprises two partition walls, the partition wall in a form of a cold or heat accumulator comprising notches in opposing edges of the partition wall and protrusions and nests on a front face and on a back face of the partition wall, said protrusions being arranged to be coupled with corresponding nests of an another accumulator, and said nests being arranged to be coupled with corresponding protrusions of said another accumulator so as to form a use-mode where a face of the accumulator is arranged to be against the face of said another accumulator, the partition wall in the form of the cold or heat accumulator is positionable to an upper part of the box body to cover at least part of the opening, the same partitional wall is positionable between adjacent half columns to form a separating wall for creating two horizontally adjacent spaces and the same partition wall is positionable to a lower part of the box body on the bottom wall, the same partition wall positionable to the upper part of the box body is supported by the half columns and at least part of the notches of the partition wall align with gaps between the half columns projecting from the side wall to form an air flow path, the cold or heat accumulator comprising a container for phase-change material.

14. The arrangement in a thermally insulated transport box according to claim 13, wherein the arrangement comprises two cold or heat accumulators forming two partition walls, and the accumulators are positioned side-by-side to cover the opening, and the accumulators are supported by the half columns.

15. The arrangement in a thermally insulated transport box according to claim 13, wherein in the arrangement the phase-change material in the container of the first accumulator has a different melting/solidifying temperature than the phase-change material in the container of the second accumulator.

16. The arrangement in a thermally insulated transport box according to claim 13, wherein the arrangement further comprises two partition walls positioned side-by-side on the bottom wall.

* * * * *